US008887491B2

(12) United States Patent
Kimura et al.

(10) Patent No.: US 8,887,491 B2
(45) Date of Patent: Nov. 18, 2014

(54) CONTROL APPARATUS FOR AN INTERNAL COMBUSTION ENGINE

(75) Inventors: Koichi Kimura, Numazu (JP); Junichi Suzuki, Susono (JP); Shuntaro Okazaki, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 14/002,188

(22) PCT Filed: Mar. 1, 2011

(86) PCT No.: PCT/JP2011/054624

§ 371 (c)(1),
(2), (4) Date: Aug. 29, 2013

(87) PCT Pub. No.: WO2012/117520

PCT Pub. Date: Sep. 7, 2012

(65) Prior Publication Data

US 2013/0333358 A1 Dec. 19, 2013

(51) Int. Cl.

| | |
|---|---|
| ***F01N 3/00*** | (2006.01) |
| ***F02D 41/02*** | (2006.01) |
| ***F02D 41/00*** | (2006.01) |
| ***F02M 25/08*** | (2006.01) |
| *F02D 41/14* | (2006.01) |

(52) U.S. Cl.

CPC ..... *F02D 41/0235* (2013.01); *F02D 41/0032* (2013.01); *F02M 25/089* (2013.01); *F02D 41/1454* (2013.01)

USPC ..... 60/285; 60/274; 60/276; 60/283

(58) Field of Classification Search

USPC ..... 60/274, 276, 299

See application file for complete search history.

(56) References Cited

U.S. PATENT DOCUMENTS

| | | | | | |
|---|---|---|---|---|---|
| 5,680,756 | A | * | 10/1997 | Harima | 123/520 |
| 5,699,778 | A | * | 12/1997 | Muraguchi et al. | 123/698 |
| 5,921,222 | A | * | 7/1999 | Freeland | 123/520 |
| 6,145,306 | A | * | 11/2000 | Takagi et al. | 60/285 |
| 6,283,088 | B1 | | 9/2001 | Takagi et al. | |
| 6,343,467 | B1 | * | 2/2002 | Muto et al. | 60/285 |

FOREIGN PATENT DOCUMENTS

| | | |
|---|---|---|
| JP | A 6-10737 | 1/1994 |
| JP | A 8-121266 | 5/1996 |

(Continued)

*Primary Examiner* — Thomas Denion
*Assistant Examiner* — Diem Tran
(74) *Attorney, Agent, or Firm* — Oliff PLC

(57) ABSTRACT

A control apparatus for an internal combustion engine determines, based on an output value of the downstream air-fuel ratio sensor, an air-fuel ratio of a gas flowing into the catalyst that is set to either a "target rich ratio" or a "target lean ratio", and determines a fuel injection amount. Disclosed is an evaporated fuel purge section for introducing an evaporated fuel generated in a fuel tank into an intake passage. The purge section starts the purge when the target air-fuel ratio is set to the target rich ratio at a purge execution condition satisfied time point at which a state has changed from a state in which the purge execution condition is unsatisfied to a state in which it is satisfied, and does not start the purge when the target air-fuel ratio is set to the target lean air-fuel ratio at the purge execution condition satisfied time point.

17 Claims, 11 Drawing Sheets

(56) References Cited

FOREIGN PATENT DOCUMENTS

| | | |
|---|---|---|
| JP | A 2000-27716 | 1/2000 |
| JP | A 2004-100623 | 4/2004 |
| JP | A 2004-156626 | 6/2004 |
| JP | A 2008-38736 | 2/2008 |
| JP | A 2009-162139 | 7/2009 |

* cited by examiner

CONTROL APPARATUS FOR AN INTERNAL COMBUSTION ENGINE

TECHNICAL FIELD

The present invention relates to a control apparatus for an internal combustion engine comprising a catalyst disposed in an exhaust passage, an evaporated fuel purge section configured to introduce evaporated fuel generated in a fuel tank into an intake passage, and a fuel injection valve(s) configured to supply fuel.

BACKGROUND ART

Conventionally, a three-way catalyst is disposed in an exhaust passage of an internal combustion engine in order to purify an exhaust gas discharged from the engine. As is well known, the three-way catalyst has an "oxygen storage function." That is, when a gas flowing into the three-way catalyst (catalyst inflow gas) contains excessive oxygen, the three-way catalyst stores the oxygen and purifies the NOx. When the catalyst inflow gas contains excessive unburnt substance, the three-way catalyst releases the oxygen which has been stored to purify the unburnt substance. Hereinafter, the three-way catalyst may also simply be referred to as a "catalyst."

A conventional air-fuel ratio control apparatus (conventional apparatus) comprises an upstream air-fuel ratio sensor and a downstream air-fuel ratio sensor that are disposed upstream and downstream of the catalyst in the exhaust passage, respectively. The conventional apparatus controls an "air-fuel ratio of a mixture supplied to the engine (air-fuel ratio of the engine)" so as to have an air-fuel ratio (detected upstream-side air-fuel ratio) represented by an output value of the upstream air-fuel ratio sensor become equal to a target air-fuel ratio (target upstream-side air-fuel ratio, target air-fuel ratio of the catalyst inflow gas). This control is also referred to as a "main feedback control."

Further, the conventional apparatus calculates a sub feedback amount so as to have an output value of the downstream air-fuel ratio sensor become equal to a "target value corresponding to a stoichiometric air-fuel ratio", and substantially changes the target upstream-side air-fuel ratio with the sub feedback amount to control the air-fuel ratio of the engine (refer to, for example, PTL 1). The air-fuel ratio control using the sub feedback amount is also referred to as a "sub feedback control."

CITATION LIST

Patent Literature

[PTL 1] Japanese Patent Application Laid-Open (kokai) No. 2009-162139

SUMMARY OF THE INVENTION

Meanwhile, the applicant has been studying an air-fuel ratio control apparatus which can maintain the emission at a favorable level, even if an "oxygen storage capacity of the catalyst is low (a maximum oxygen storage amount is small, such as when the catalyst has deteriorated, and a capacity of the catalyst is small)." For example, one of such air-fuel ratio control apparatuses under study determines a state of the catalyst (oxygen storing state) without delay based on the output value of the downstream air-fuel ratio sensor, and controls, based on the result of that determination, the air-fuel ratio of the engine so as to have the air-fuel ratio of the catalyst inflow gas become equal to an air-fuel ratio other than the stoichiometric air-fuel ratio.

More specifically, such a control apparatus sets the target air-fuel ratio to a "target rich air-fuel ratio smaller than the stoichiometric air-fuel ratio", when it determines, based on the output value Voxs of the downstream air-fuel ratio sensor, that the state of the catalyst has become/entered an oxygen excessive state (lean state). Further, the control apparatus sets the target air-fuel ratio to a "target lean air-fuel ratio larger than the stoichiometric air-fuel ratio", when it determines, based on the output value Voxs of the downstream air-fuel ratio sensor, that the state of the catalyst has become/entered an oxygen shortage state (rich state).

Meanwhile, the engine may include the evaporated fuel purge section. The evaporated fuel purge section makes a canister adsorb the evaporated fuel (gas) generated in the fuel tank, and introduces the evaporated fuel adsorbed in the canister into the intake passage of the engine when a predetermined purge execution request condition is satisfied. This allows the evaporated fuel to be burned in combustion chambers of the engine, and then to be discharged into the air. Introducing the evaporated fuel into the intake passage of the engine is referred to as an evaporated fuel purge.

The evaporated fuel purge is one of factors that disturb the air-fuel ratio of the engine. Generally, immediately after the evaporated fuel purge is started, the fuel by the evaporated fuel purge in addition to the fuel from the fuel injection valve is supplied to the engine, and therefore, the air-fuel ratio of the engine temporarily becomes small. Thus, if the evaporated fuel purge is started when the capacity of the catalyst for purifying the unburnt substance is not high, the unburnt substance whose amount is equal to or larger than an amount of unburnt substance which the catalyst can purify flows into the catalyst. In such a case, a discharge amount of the unburnt substance increases so that the emission becomes degraded.

The present invention is made to solve the problem described above. That is, one of objects of the present invention is to provide a control apparatus for an internal combustion engine, which can reduce/depress a degree of degrading the emission caused by the start of the evaporated fuel purge by a control (evaporated fuel purge start control) for allowing and prohibiting the start of the evaporated fuel purge in accordance with the target air-fuel ratio.

The control apparatus (present invention apparatus) for an internal combustion engine of the present invention comprises:

a catalyst disposed in an exhaust passage of the engine;

a downstream air-fuel ratio sensor disposed in the exhaust passage and at a position downstream of the catalyst;

a target air-fuel ratio determining section configured to determine, based on an "output value of the downstream air-fuel ratio sensor", which a "target air-fuel ratio being a target value of an air-fuel ratio of a gas flowing into the catalyst" should be set to, a "target rich air-fuel ratio smaller than a stoichiometric air-fuel ratio" or a "target lean air-fuel ratio larger than the stoichiometric air-fuel ratio";

a fuel injection valve configured to inject a fuel to the engine;

a fuel injection control section configured to determine a "fuel injection amount being an amount of the fuel injected from the fuel injection valve" according to the target air-fuel ratio, and to have the fuel having the determined fuel injection amount be injected from the fuel injection valve; and an evaporated fuel purge section configured to perform an evaporated fuel purge when a predetermined purge execution request condition is satisfied, the evaporated fuel purge being for introducing an evaporated fuel generated in a "fuel tank storing the fuel supplied to the fuel injection valve" into an intake passage of the engine.

Further, the evaporated fuel purge section is configured;

so as to start the evaporated fuel purge when the target air-fuel ratio is set at the target rich air-fuel ratio at a point in time (hereinafter, referred to as a "purge execution request condition satisfied time point") which is a point in time at which a state changes from a state in which the purge execution request condition is unsatisfied to a state in which the purge execution request condition is satisfied; and so as not to start the evaporated fuel purge when the target air-fuel ratio is set at the target lean air-fuel ratio at the purge execution request condition satisfied time point, and so as to thereafter start the evaporated fuel purge when the target air-fuel ratio is set at the target rich air-fuel ratio after the target air-fuel ratio is changed to the target rich air-fuel ratio.

As described above, when the evaporated fuel purge is started, the air-fuel ratio of the engine temporarily becomes excessively small (or temporarily becomes an excessively rich air-fuel ratio) due to the evaporated fuel purge. Accordingly, a large amount of unburnt substance flows into the catalyst. At this stage, if the state of the catalyst is the oxygen shortage state (rich state), and thus, the capacity for purifying unburnt substance of the catalyst is low, the unburnt substance is discharged to the downstream of the catalyst without being purified by the catalyst.

In contrast, according to the present invention apparatus, the target air-fuel ratio when the evaporated fuel purge is started is the target rich air-fuel ratio, and is not the target lean air-fuel ratio. Therefore, the state of the catalyst when the evaporated fuel purge is started is the "oxygen excessive state (lean state)." In other words, the evaporated fuel purge is started when the catalyst is in a state in which the catalyst can purify a large amount of unburnt oxygen. Accordingly, even if a large amount of unburnt substance flows into the catalyst due to the evaporated fuel purge, the catalyst can purge a large part of such unburnt substance. Consequently, the degree of degrading the emission can be reduced at the start of the evaporated fuel purge.

In this case, it is preferable that the evaporated fuel purge section be configured to change a point in time at which the evaporated fuel purge is started based on whether an operating state of the engine is a first operating state or a second operating state.

For example, the first operating state is a state in which the emission is prioritized, and the second operating state is a state in which the drivability is prioritized. More specifically, the first operating state may be a low load operating state, and the second operating state may be a high load operating state. Further, for example, the first operating state may be a low engine rotational speed operating state, and the second operating state may be a high engine rotational speed operating state. Furthermore, for example, the first operating state is a state in which an engine operating state represented by "the load of the engine and the engine rotational speed" is in an operating region of "a low load and a low engine rotational speed side", and the second operating state is a state in which the engine operating state represented by "the load of the engine and the engine rotational speed" is in an operating region of "a high load and a high engine rotational speed side."

More specifically, it is preferable that the evaporated fuel purge section be configured as follows.

(1) In a case in which the operating state of the engine at the purge execution request condition satisfied time point is the first operating state:

(1A) the evaporated fuel purge section starts the evaporated fuel purge when the target air-fuel ratio is set at the target rich air-fuel ratio; and (1B) the evaporated fuel purge section does not start the evaporated fuel purge when the target air-fuel ratio is set at the target lean air-fuel ratio, and starts the evaporated fuel purge when the target air-fuel ratio is set at the target rich air-fuel ratio after the target air-fuel ratio is set/changed to the target rich air-fuel ratio.

According to the above configuration, the evaporated fuel purge is started when the state of the catalyst is in the "oxygen excessive state (lean state)", as described above. Therefore, even if a large amount of the unburnt substance flows into the catalyst when the evaporated fuel purge is started, the catalyst can purify the large part of the unburnt substance. Consequently, when the operating state of the engine is in the first operating state, the degree of degrading the emission at the start of the evaporated fuel purge can be reduced.

Meanwhile, as described above, the air-fuel ratio of the engine temporarily becomes small immediately after the start of the evaporated fuel purge. Thus, if the evaporated fuel purge is started when the target air-fuel ratio is the target rich air-fuel ratio, the air-fuel ratio of the engine becomes extremely small. As a result, a vibration of the engine may occur due to an unstable combustion of the mixture, and the like, and thus, the drivability may become degraded. In view of the above, it is preferable that the evaporated fuel purge section be configured as follows.

(2) In a case in which the operating state of the engine at the purge execution request condition satisfied time point is the second operating state:

(2A) the evaporated fuel purge section starts the evaporated fuel purge when the target air-fuel ratio is set at the target lean air-fuel ratio; and (2B) the evaporated fuel purge section does not start the evaporated fuel purge when the target air-fuel ratio is set at the target rich air-fuel ratio, and starts the evaporated fuel purge when the target air-fuel ratio is set at the target lean air-fuel ratio after the target air-fuel ratio is set/changed to the target lean air-fuel ratio.

According to the above configuration, the evaporated fuel purge is started when the target air-fuel ratio is the target lean air-fuel ratio. Therefore, the air-fuel ratio of the engine is made closer to the stoichiometric air-fuel ratio owing to the start of the evaporated fuel purge. Consequently, it is unlikely that the vibration of the engine occurs, because the combustion of the mixture becomes stable, and so on. Accordingly, the drivability (running performance) of the engine and a vehicle on which the engine is mounted can be improved.

It should be noted that, in the above case, the evaporated fuel purge is started when the state of the catalyst is the "oxygen shortage state (rich state)." Accordingly, there may be a possibility that the emission becomes degraded, however, the second operating state is generally the state in which the load and/or the engine rotational speed are high, and thus, a temperature of the catalyst is high at the start of the evaporated fuel purge so that the purifying capacity of the catalyst is high. Therefore, the possibility that the emission becomes extremely degraded is low due to the start of the evaporated fuel purge. In addition, many of the engines comprise a downstream-side catalyst at a position downstream of that catalyst. When the operating state is the second operating state, a temperature of the downstream-side catalyst reaches a certain high temperature. Accordingly, the unburnt substance is also purified by the downstream-side catalyst. Thus, the possibility that the emission becomes extremely degraded due to the start of the evaporated fuel purge is very low.

In one of aspects of the present invention apparatus, the evaporated fuel purge section can be configured in such a manner that:

the evaporated fuel purge section estimates, in a case in which the operating state of the engine at the purge execution request condition satisfied time point is the first operating state, a first time period until the target air-fuel ratio is switched over to the target lean air-fuel ratio when the target air-fuel ratio is the target rich air-fuel ratio; and does not start the evaporated fuel purge if the estimated first time period is shorter than a first predetermined threshold time period.

In the case in which the operating state of the engine is the first operating state, when the target air-fuel ratio is set at the target rich air-fuel ratio at the purge execution request condition satisfied time point, the state of the catalyst is the oxygen excessive state at that point in time, and thus, it is preferable that the evaporated fuel purge be started. However, it takes a certain time for the fuel introduced into the intake passage by the evaporated fuel purge to be burned to be an exhaust gas and to reach the catalyst as the exhaust gas. Accordingly, in a case in which the evaporated fuel purge is carried out when the time period (first time period) until the target air-fuel ratio is switched over to the target lean air-fuel ratio is shorter than the first threshold time period, the state of the catalyst has already become the oxygen shortage state (the target air-fuel ratio has already been changed to the target lean air-fuel ratio) at a point in time at which the fuel introduced into the intake passage by the evaporated fuel purge was combusted to be the exhaust gas, and the exhaust gas has reached the catalyst. As a result, the emission may become degraded.

In contrast, according to the aspect described above, even when the operating state of the engine at the purge execution request condition satisfied time point is the first operating state, and the target air-fuel ratio is set at the target rich air-fuel ratio, the evaporated fuel purge is not started if the estimated first time period is shorter than the first threshold time period. Consequently, it can be avoided that the state of the catalyst is the oxygen shortage state at the point in time at which the fuel introduced into the intake passage by the evaporated fuel purge was combusted to be the exhaust gas, and the exhaust gas has reached the catalyst. Accordingly, the degrading of the emission can be avoided.

In one of aspects of the present invention apparatus, the evaporated fuel purge section can be configured in such a manner that:

the evaporated fuel purge section estimates, in a case in which the operating state of the engine at the purge execution request condition satisfied time point is the second operating state, a second time period until the target air-fuel ratio is switched over to the target rich air-fuel ratio when the target air-fuel ratio is the target lean air-fuel ratio; and does not start the evaporated fuel purge if the estimated second time period is shorter than a predetermined second threshold time period.

In the case in which the operating state of the engine is the second operating state, when the target air-fuel ratio is set at the target lean air-fuel ratio at the purge execution request condition satisfied time point, it is preferable that the evaporated fuel purge be started. However, it takes a certain time for the evaporated fuel to be introduced into the combustion chambers, from a point in time at which the evaporated fuel purge is started. Accordingly, in a case in which the evaporated fuel purge is carried out when the time period (second time period) until the target air-fuel ratio is switched over to the target rich air-fuel ratio is shorter than the second threshold time period, the target air-fuel ratio has already been changed to the target rich air-fuel ratio at a point in time at which the fuel introduced into the intake passage by the evaporated fuel purge has reached the combustion chambers. As a result, the drivability may become degraded.

In contrast, according to the aspect described above, even when the operating state of the engine at the purge execution request condition satisfied time point is the second operating state, and the target air-fuel ratio is set at the target lean air-fuel ratio, the evaporated fuel purge is not started if the estimated second time period is shorter than the second threshold time period. Consequently, it can be avoided that the target air-fuel ratio has already been changed to the target rich air-fuel ratio before the point in time at which the fuel introduced into the intake passage by the evaporated fuel purge has reached the combustion chambers. Therefore, the degrading of the drivability can be avoided.

Other objects, features, and advantages of the present invention apparatus will be readily understood from the following description of each of embodiments of the present invention apparatus with reference to the accompanying drawings.

DESCRIPTION OF EMBODIMENTS

Each of embodiments of a control apparatus for an internal combustion engine (hereinafter, also simply referred to as a "control apparatus") according to the present invention will next be described with reference to the drawings. The control apparatus is a part of an air-fuel ratio control apparatus for controlling an air-fuel ratio (air-fuel ratio of the engine) of a mixture supplied to the internal combustion engine, and further, a part of a fuel injection amount control apparatus for controlling a fuel injection amount, as well as a part of an evaporated fuel purge control apparatus for controlling a purge amount of the evaporated fuel.

First Embodiment

Structure

Figure 1:
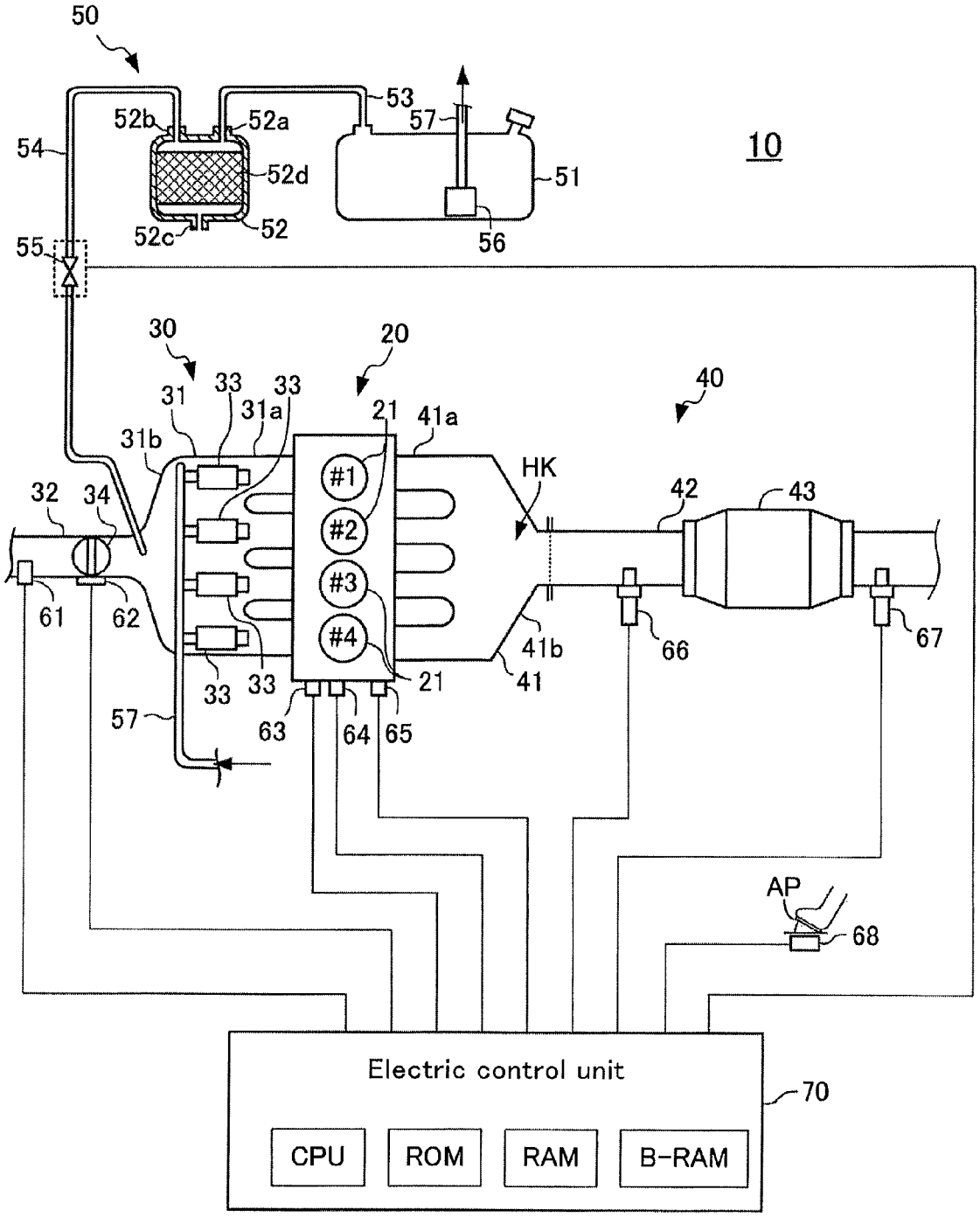
FIG. 1 is a schematic plan view of an internal combustion engine to which a control apparatus according to each of embodiments of the present invention is applied.

FIG. 1 schematically shows a configuration of a system in which a control apparatus according to a first embodiment of the present invention (hereinafter, referred to as a "first control apparatus") is applied to a 4 cycle, spark-ignition, multi-cylinder (in the present example, in-line 4 cylinder), gasoline internal combustion engine 10.

The engine 10 includes a main body section 20, an intake system 30, an exhaust system 40, and an evaporated fuel supplying system 50.

The main body section 20 includes a cylinder block section and a cylinder head section. The main body section 20 includes a plurality of cylinders (combustion chambers) 21. Each of the cylinders is communicated with unillustrated "intake ports and the exhaust ports." A communication portion between the intake port and the combustion chamber is opened and closed by an unillustrated intake valve. A communication portion between the exhaust port and the combustion chamber is opened and closed by an unillustrated exhaust valve. Each of unillustrated spark plugs is disposed in each of the combustion chambers 21.

The intake system 30 comprises an intake manifold 31, an intake pipe 32, a plurality of fuel injection valves (injectors) 33, and a throttle valve 34.

The intake manifold 31 includes a plurality of branch portions 31*a* and a surge tank 31*b*. Each one end of a plurality of the branch portions 31*a* is connected to each of the intake ports. Each of the other ends of a plurality of the branch portions 31*a* is connected to the surge tank 31*b*.

One end of the intake pipe 32 is connected to the surge tank 31*b*. An unillustrated air-filter is provided at the other end of the intake pipe 32.

The fuel injection valve 33 is provided for each one of the cylinders (combustion chambers) 21 one by one. The fuel injection valve 33 is disposed at the intake port. That is, each of a plurality of the cylinders comprises the fuel injection valve 33 which supplies a fuel independently from the other cylinders. The fuel injection valve 33 injects, in response to an instructed injection signal, the "fuel having an instructed fuel injection amount contained in that instructed injection signal", when it is normal, into the intake port (and thus, for the cylinder 21 corresponding to that fuel injection valve 33).

More specifically, the fuel is supplied to the fuel injection valve 33 via a fuel supply pipe 57 connected to a fuel tank 51 described later. A pressure of the fuel supplied to the fuel injection valve 33 is controlled by an unillustrated pressure regulator in such a manner that a pressure difference between the pressure of the fuel and a pressure in the intake ports is constant. The fuel injection valve 33 is opened for a time duration corresponding to the instructed fuel injection amount. Thus, when the fuel injection valve 33 is normal, the fuel injection valve 33 injects the fuel having an amount which is the same as the instructed fuel injection amount.

The throttle valve 34 is rotatably supported by the intake pipe 32. The throttle valve 34 is configured so as to vary an opening sectional area of an intake passage. The throttle valve 34 is configured so as to be rotated by an unillustrated throttle valve actuator in the intake pipe 32.

The exhaust system 40 includes an exhaust manifold 41, an exhaust pipe 42, an upstream-side catalytic converter (catalyst) 43 disposed in the exhaust pipe 42, and an "unillustrated downstream-side catalytic converter (catalyst)" disposed in the exhaust pipe at a position downstream of the upstream-side catalyst 43.

The exhaust manifold 41 comprises a plurality of branch portions 41*a* and an aggregated portion 41*b*. One end of each of a plurality of the branch portions 41*a* is connected to each of a plurality of the exhaust ports. The other end of each of a plurality of the branch portions 41*a* is connected to the aggregated portion 41*b*. Since the aggregated portion 41*b* is a portion into which exhaust gases discharged from a plurality (two or more, and four in the present example) of the cylinders aggregate (merge), the aggregated portion 41*b* is also referred to as an exhaust gas aggregated portion HK.

The exhaust pipe 42 is connected to the aggregated portion 41*b*. The exhaust ports, the exhaust manifold 41, and the exhaust pipe 42 constitute an exhaust passage.

Each of the upstream-side catalyst 43 and the downstream-side catalyst is a so-called three-way catalytic unit (exhaust gas purifying catalyst) which supports active components formed of noble (precious) metals (catalytic substances) such as Platinum, Rhodium, and Palladium. Each catalyst has a function for oxidizing unburnt substances such as HC, CO, $H_2$, and so on, and reducing nitrogen oxide (NOx), when an air-fuel ratio of a gas flowing into the catalyst is equal to an "air-fuel ratio (e.g., stoichiometric air-fuel ratio) in a window of the three-way catalyst." This function is referred to as a catalytic function.

Further, each of the catalysts has an oxygen storage function for storing oxygen. That is, when the gas flowing into each of the catalyst (catalyst inflow gas) contains excessive oxygen, the catalyst stores the oxygen and purifies the NOx. When the catalyst inflow gas contains excessive unburnt substance, each of the catalyst releases the stored oxygen to purify the unburnt substance. This oxygen storage function is given by oxygen storage substances such as ceria ($CeO_2$) supported in the catalyst. Each of the catalyst can purify the unburnt substance and the nitrogen oxides even when the air-fuel ratio deviates from the stoichiometric air-fuel ratio owing to the oxygen storage function. That is, the oxygen storage function expands a width of the window.

The evaporated fuel supplying system comprises the fuel tank 51, a canister 52, a vapor collection pipe 53, a purge passage pipe 54, a purge control valve 55, and a fuel pump 56.

The fuel tank 51 stores the fuel which is injected/supplied to the engine 10 from the fuel injection valve 33.

The canister 52 is a "well-known charcoal canister" which stores the evaporated fuel (evaporated fuel gas) generated in the fuel tank 51. The canister 52 includes a housing which has a tank port 52*a*, a purge port 52*b*, an atmosphere port 52*c* exposed to the air (atmosphere). The canister 52 accommodates (holds), in the housing, adsorbents (e.g. activated charcoal) 52*d* for adsorbing the evaporated fuel.

One end of the vapor collection pipe 53 is connected with an upper portion of the fuel tank 51, and the other end is connected with the tank port 52*a*. The vapor collection pipe 53 is a pipe for introducing the evaporated fuel generated in the fuel tank 51 into the canister 52 from the fuel tank 51.

One end of the purge passage pipe 54 is connected with the purge port 52*b*, and the other end is connected with the surge tank 31*b* (that is, the intake passage at a position downstream of the throttle valve 34). The purge passage pipe 54 is a pipe for introducing the evaporated fuel discharged from the adsorbents 52*d* in the canister 52 into the surge tank 31*b*. The vapor collection pipe 53 and the purge passage pipe 54 constitute a purge passage (purge passage portion).

The purge control valve 55 is disposed/interposed in the purge passage pipe 54. The purge control valve 55 is configured so as to vary a cross-sectional area of a passage formed by the purge passage pipe 54 by adjusting an opening degree (opening period) based on a drive signal having a duty ratio DPG serving as an instruction signal. The purge control valve 55 fully/completely closes the purge passage pipe 54 when the duty ratio DPG is "0".

The fuel pump 56 is configured so as to supply the fuel stored in the fuel tank 51 to the fuel injection valve 33 via the fuel supply pipe 57.

In the thus configured evaporated fuel supplying system 50, the evaporated fuel generated in the fuel tank 51 is stored in the canister 52 when the purge control valve 55 is fully closed. When the purge control valve 55 is opened, the evaporated fuel which has been stored in the canister 52 is released/discharged to the surge tank 31*b* (intake passage at the position downstream of the throttle valve 34) via the purge passage pipe 54, so as to be supplied to the combustion chambers 21 (engine 10). That is, when the purge control valve 55 is opened, the evaporated fuel is purged (an "evaporated fuel gas purge" or a "purge" is carried out).

The system comprises a hot-wire air flow meter 61, a throttle position sensor 62, a water temperature sensor 63, a crank position sensor 64, an intake cam position sensor 65, an upstream (upstream-side) air-fuel ratio sensor 66, a downstream (downstream-side) air-fuel ratio sensor 67, and an accelerator opening sensor 68.

The air flow meter 61 outputs an signal representing a mass flow rate (intake air flow rate) Ga of an intake air flowing through the intake pipe 32. That is, the intake air flow rate Ga represents an intake air amount introduced into the engine 10 per unit time.

The throttle position sensor 62 detects an opening of the throttle valve 34 (throttle valve opening), and outputs a signal representing the throttle valve opening TA.

The water temperature sensor 63 detects a temperature of a cooling water of the engine 10 so as to output a signal representing the cooling water temperature THW. The cooling water temperature THW is an engine operating state indicating value indicative of a warming up state of the engine 10 (temperature of the engine 10).

The crank position sensor 64 outputs a signal which includes a narrow pulse generated every time the crank shaft rotates 10 degrees and a wide pulse generated every time the crank shaft rotates 360 degrees. This signal is converted into an engine rotational speed NE by an electric control unit 70 described later.

The intake cam position sensor 65 outputs a single pulse when the intake camshaft rotates 90 degrees from a predetermined angle, when the intake camshaft rotates 90 degrees after that, and when the intake camshaft further rotates 180 degrees after that. Based on the signals from the crank position sensor 64 and the intake cam position sensor 65, the electric control unit 70, which will be described later, obtains an absolute crank angle CA, while using, as a reference, a compression top dead center of a reference cylinder (e.g., the first cylinder). This absolute crank angle CA is set to "0° crank angle" at the compression top dead center of the reference cylinder, increases up to 720° crank angle in accordance with the rotational angle of the crank shaft, and is again set to 0° crank angle at that point in time.

The upstream air-fuel ratio sensor 66 is disposed at a position between the aggregated portion 41*b* (exhaust gas aggregated portion HK) of the exhaust manifold 41 and the upstream-side catalyst 43, and in either one of the exhaust manifold 41 and the exhaust pipe 42.

The upstream air-fuel ratio sensor 66 is a "wide range air-fuel ratio sensor of a limiting current type having a diffusion resistance layer" described in, for example, Japanese Patent Application Laid-Open (kokai) No. Hei 11-72473, Japanese Patent Application Laid-Open No. 2000-65782, and Japanese Patent Application Laid-Open No. 2004-69547, etc.

Figure 2:
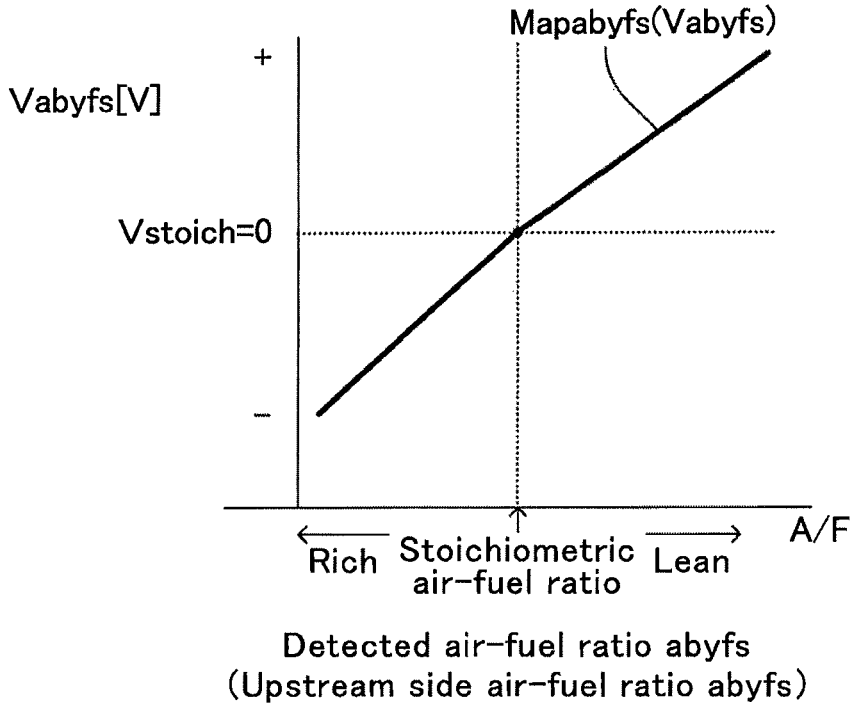
FIG. 2 is a graph showing a relationship between an output value of an upstream air-fuel ratio sensor shown in FIG. 1 and an air-fuel ratio of a gas flowing into a catalyst shown in FIG. 1.

The upstream air-fuel ratio sensor 66 outputs an output value Vabyfs according to an air-fuel ratio of an exhaust gas flowing through the position at which the upstream air-fuel ratio sensor 66 is disposed (i.e., an air-fuel ratio of a "catalyst inflow gas" which is a gas flowing into the catalyst 43, an upstream-side air-fuel ratio abyfs). As shown in FIG. 2, the output values Vabyfs increases (or becomes larger), as the air-fuel ratio of the catalyst inflow gas (upstream air-fuel ratio abyfs) becomes larger (i.e. becomes leaner).

The electric control unit 70 stores an air-fuel ratio conversion table (map) Mapabyfs which defines a relationship between the output value Vabyfs and the upstream air-fuel ratio abyfs, shown in FIG. 2. The electric control unit 70 detects an actual upstream-side air-fuel ratio abyfs (or obtains the detected upstream-side air-fuel ratio abyfs) by applying the output value Vabyfs to the air-fuel ratio conversion table Mapabyfs.

Referring back to FIG. 1 again, the downstream air-fuel ratio sensor 67 is disposed in the exhaust pipe 42. The position at which the downstream air-fuel ratio sensor 67 is disposed is a position downstream of the upstream-side catalyst 43 and upstream of the downstream-side catalyst (i.e., in the exhaust passage and between the upstream-side catalyst 43 and the downstream-side catalyst). The downstream air-fuel ratio sensor 67 is a well-known electro-motive-force-type oxygen concentration sensor (a well-known concentration-cell-type oxygen concentration sensor using a solid electrolyte such as stabilized zirconia). The downstream air-fuel ratio sensor 67 is designed to generate an output value Voxs corresponding to the air-fuel ratio of a gas to be detected, the gas flowing through a portion of the exhaust passage where the downstream air-fuel ratio sensor 67 is disposed. In other words, the output value Voxs is a value corresponding to the air-fuel ratio of the gas which flows out from the upstream-side catalyst 43 and flows into the downstream-side catalyst.

Figure 3:
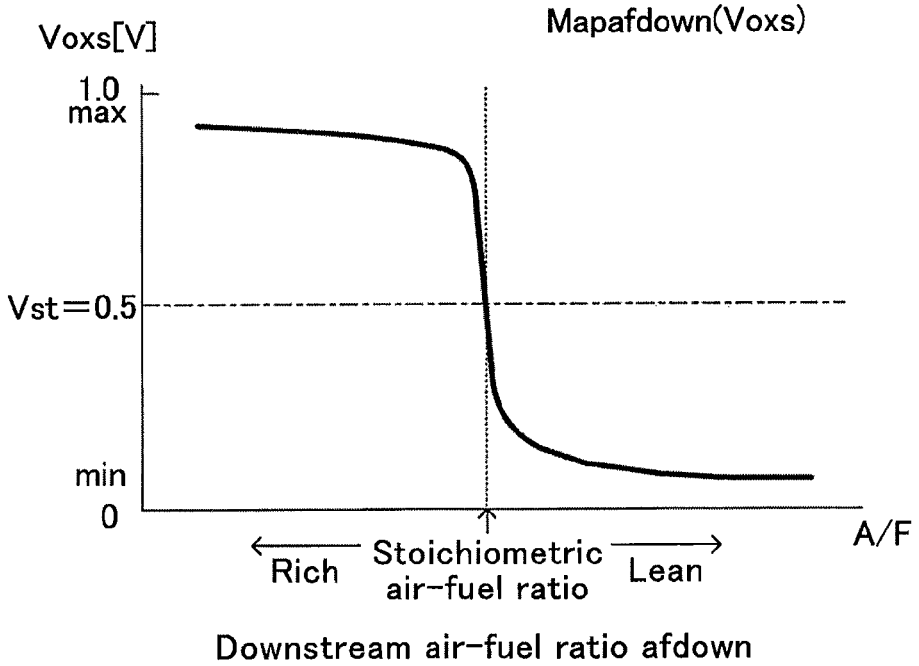
FIG. 3 is a graph showing a relationship between an output value of a downstream air-fuel ratio sensor shown in FIG. 1 and an air-fuel ratio of a gas flowing out from the catalyst shown in FIG. 1.

As shown in FIG. 3, the output value Voxs becomes equal to a maximum output value max (e.g., about 0.9 V or 1.0 V) when an air-fuel ratio of a gas to be detected is richer than the stoichiometric air-fuel ratio. The output value Voxs becomes equal to a minimum output value min (e.g., about 0.1 V or 0 V) when the air-fuel ratio of the gas to be detected is leaner than the stoichiometric air-fuel ratio. Further, the output value Voxs becomes equal to a voltage Vst (middle value Vmid, mid voltage Vst, e.g., about 0.5 V) which is an approximately middle value between the maximum output value max and the minimum output value min, when the air-fuel ratio of the gas to be detected is equal to the stoichiometric air-fuel ratio. The output value Voxs rapidly changes from the maximum output value max to the minimum output value min, when the air-fuel ratio of the gas to be detected changes from an air-fuel ratio richer than the stoichiometric air-fuel ratio to an air-fuel ratio leaner than the stoichiometric air-fuel ratio. Similarly, the output value Voxs rapidly changes from the minimum output value min to the maximum output value max, when the air-fuel ratio of the gas to be detected changes from an air-fuel ratio leaner than the stoichiometric air-fuel ratio to an air-fuel ratio richer than the stoichiometric air-fuel ratio.

The accelerator opening sensor 68 shown in FIG. 1 outputs a signal representing the operation amount Accp (accelerator pedal operation amount, opening of the accelerator pedal AP) of the accelerator pedal AP operated by a driver. The accelerator pedal operation amount Accp becomes larger as the operation amount of the accelerator pedal AP becomes larger.

The electric control unit 70 is a well-known microcomputer, comprising "a CPU; a ROM for storing in advance programs executed by the CPU, tables (maps, functions), constants, and the like; a RAM into which the CPU temporarily stores data if needed; a backup RAM (B-RAM), an interface including an AD converter, and so on".

The backup RAM is supplied with an electric power from a battery mounted on the vehicle on which the engine 10 is mounted, regardless of a position (off-position, start position, on-position, and so on) of an unillustrated ignition key switch of the vehicle. The backup RAM is configured in such a manner that data is stored in (written into) the backup RAM according to an instruction of the CPU while the electric power is supplied to the backup RAM, and the backup RAM holds (retains, stores) the data in such a manner that the data can be read out. Accordingly, the backup RAM can retain the data while the operation of the engine 10 is stopped.

When the electric power supply to the backup RAM is stopped due to a removal of the battery from the vehicle, or the like, the backup RAM can not hold the data. Thus, the backup RAM initialize (set default values to) data to be held in the backup RAM. It should be noted that the backup RAM may be a readable-writable volatile memory such as an EEPROM.

The electric control unit 70 is connected to the above described sensors, and the like, so as to supply signals from those sensors to the CPU. Further, the electric control unit 70 is configured to send drive signals (instruction signals) to the spark plugs (in actuality, igniters), each being provided to each cylinder; the fuel injection valves 33, each being provided to each cylinder; the purge control valve 55; the throttle valve actuator; and so on, according to instructions from the CPU.

It should be noted that the electric control unit 70 sends the instruction signal to the throttle valve actuator, in such a manner that the throttle valve opening TA is increased as the obtained accelerator pedal operation amount Accp becomes larger. That is, the electric control unit 70 comprises a throttle valve driving section configured to change/vary the opening degree of the "throttle valve 34 provided in the intake passage of the engine 10" in accordance with an acceleration amount (accelerator pedal operation amount Accp) of the engine 10 adjusted by the driver.

(Outline of an Operation of the First Control Apparatus)

The first control apparatus determines, based on the output value Voxs of the downstream air-fuel ratio sensor 67, whether the state of the catalyst 43 (oxygen storing state) is an oxygen excessive state (a lean state, a state in which an oxygen storage amount of the catalyst 43 is close to a maximum oxygen storage amount Cmax, that is, a state in which the oxygen storage amount of the catalyst 43 is equal to or larger than a high side threshold value), or an oxygen shortage state (a rich state, a state in which little oxygen is stored in the catalyst 43, that is, a state in which the oxygen storage amount of the catalyst 43 is equal to or smaller a "low side threshold value equal to or smaller than the high side threshold value)."

More specifically, the first control apparatus determines that the state of the catalyst 43 becomes/enters the oxygen shortage state, when it has been determined that the state of the catalyst 43 is the oxygen excessive state, a change amount ΔVoxs of the output value Voxs per unit time is a positive value, and its magnitude |ΔVoxs| becomes larger than a rich determining threshold value dRichth. At this point in time, the first control apparatus sets a value of a catalyst lean state indicating flag XCCROLean to "0."

Further, the first control apparatus determines that the state of the catalyst 43 becomes/enters the oxygen excessive state, when it has been determined that the state of the catalyst 43 is the oxygen shortage state, the change amount ΔVoxs is a negative value, and the magnitude |ΔVoxs| becomes larger than a lean determining threshold value dLeanth. At this point in time, the first control apparatus sets the value of the catalyst lean state indicating flag XCCROLean to "1."

It should be noted that the first control apparatus may determine that the state of the catalyst 43 becomes/enters the oxygen shortage state, when it has been determined that the state of the catalyst 43 is the oxygen excessive state, and the change amount ΔVoxs becomes larger than the rich determining threshold value VRichth. Further, the first control apparatus may determine that the state of the catalyst 43 becomes/enters the oxygen excessive state, when it has been determined that the state of the catalyst 43 is the oxygen shortage state, and the change amount ΔVoxs becomes smaller than the lean determining threshold value VLeanth.

When the state of the catalyst 43 is the oxygen shortage state, excessive oxygen should be made to be flowed into the catalyst 43, and thus, the target air-fuel ratio abyfr (requested air-fuel ratio, target upstream air-fuel ratio abyfr) which is the target value for the catalyst inflow gas is a "target lean air-fuel ration afLean larger than the stoichiometric air-fuel ratio." In view of the above, the first control apparatus sets the target air-fuel ratio abyfr to the target lean air-fuel ration afLean when it determines that the state of the catalyst 43 is the oxygen shortage state.

When the state of the catalyst 43 is the oxygen excessive state, excessive unburnt substance should be made to be flowed into the catalyst 43, and thus, the target air-fuel ratio abyfr of the catalyst inflow gas should be a "target rich air-fuel ration afRich smaller than the stoichiometric air-fuel ratio." In view of the above, the first control apparatus sets the target air-fuel ratio abyfr to the target rich air-fuel ration afRich when it determines that the state of the catalyst 43 is the oxygen excessive state.

On the other hand, when the predetermined purge execution request condition becomes satisfied (at a purge execution request condition satisfied time point at which a state is changed from a state in which the purge execution request condition is unsatisfied to a state in which the purge execution request condition is satisfied), the first control apparatus immediately opens the purge control valve 55 to introduce the evaporated fuel into the intake passage (i.e., it starts the evaporated fuel purge), if the target air-fuel ratio abyfr is set to the target rich air-fuel ratio afRich.

In contrast, the first control apparatus maintains the purge control valve 55 at a closed state, if the target air-fuel ratio abyfr is set to the target lean air-fuel ratio afLean at the purge execution request condition satisfied time point. That is, in this case, the first control apparatus does not start the evaporated fuel purge. Thereafter, when the target air-fuel ratio abyfr is set/changed to the target rich air-fuel ratio afRich (or alternatively, when the target air-fuel ratio abyfr is set at the target rich air-fuel ratio afRich after a point in time at which the target air-fuel ratio abyfr was set/changed to the target rich air-fuel ratio afRich), the first control apparatus opens the purge control valve 55 to introduce the evaporated fuel into the intake passage (that is, it starts the evaporated fuel purge).

When the evaporated fuel purge is started, the air-fuel ratio of the engine temporarily becomes small (excessively rich air-fuel ratio) due to the evaporated fuel purge. Therefore, a large amount of unburnt substance flows into the catalyst 43. At this point in time, if the state of the catalyst 43 is the oxygen shortage state (rich state), and thus, the capacity for purifying unburnt substance of the catalyst 43 is low, unburnt substance flows out to the downstream portion of the catalyst 43 without being purified in the catalyst 43

In contrast, according to the first control apparatus, the target air-fuel ratio abyfr at the purge execution request condition satisfied time point is the target rich air-fuel ratio afRich, and is not the target lean air-fuel ratio afLean. That is, the state of the catalyst 43 when the evaporated fuel purge is started is the "oxygen excessive state (lean state)." Accordingly, even if a large amount of unburnt substance flows into the catalyst 43 due to the start of the evaporated fuel purge, the catalyst 43 can purify a large part of the unburnt substance. Consequently, a degree of degrading the emission at the start of the evaporated fuel purge can be reduced.

(Actual Operation)

The actual operation of the first control apparatus will next be described.

<Fuel Injection Control>

Figure 4:
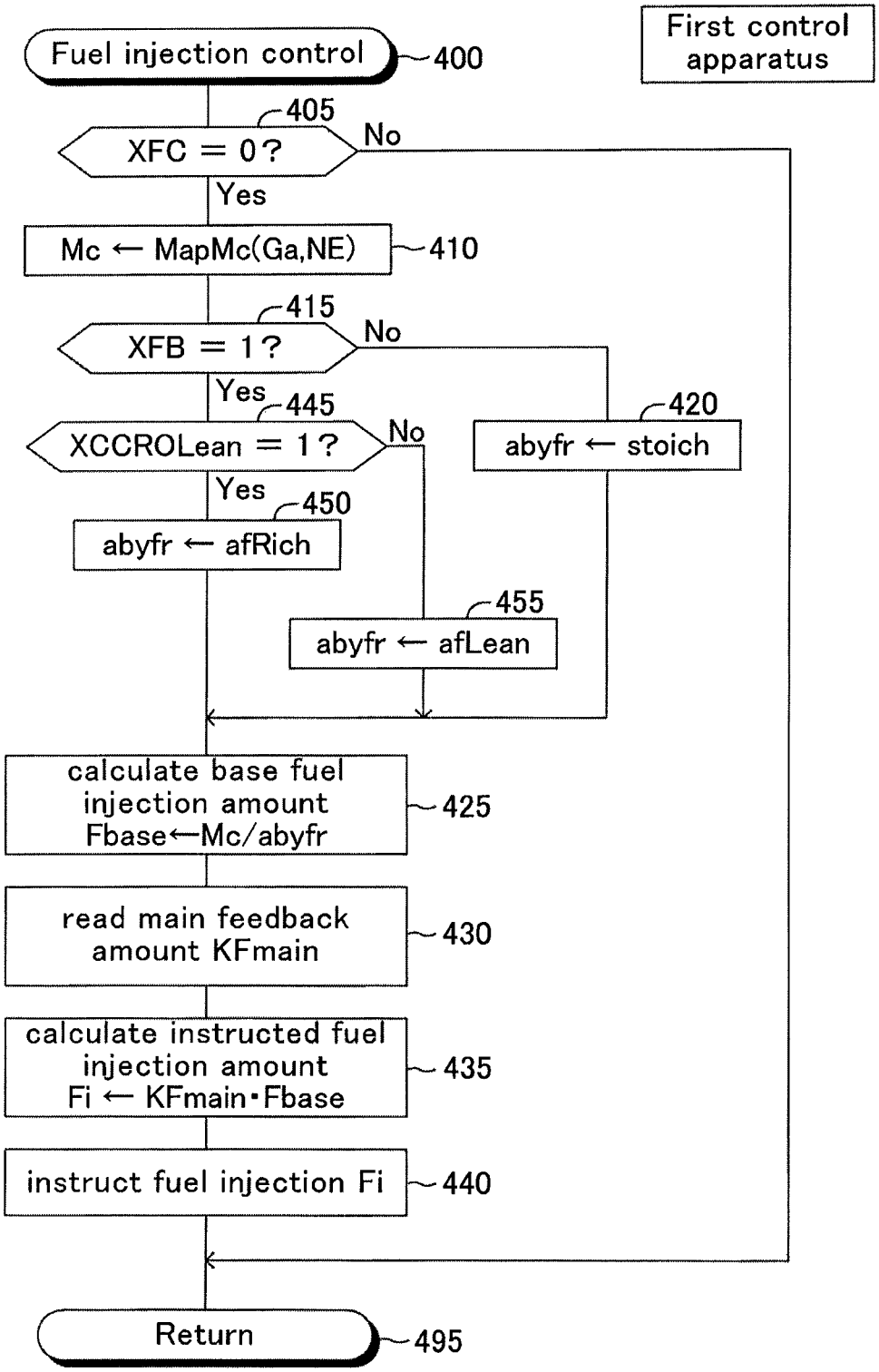
FIG. 4 is a flowchart showing a routine, executed by a CPU of a control apparatus (first control apparatus) according to a first embodiment of the present invention.

Every time the crank angle of any one of the cylinders reaches a predetermined crank angle before its intake top dead center, the CPU of the first control apparatus repeatedly executes a fuel injection control routine shown by a flowchart in FIG. 4 for that cylinder. The predetermined crank angle is, for example, BTDC 90° CA (90 degree before the intake top dead center). The cylinder whose crank angle reaches the predetermined crank angle is also referred to as a "fuel injection cylinder." The CPU calculates an instructed fuel injection amount (final fuel injection amount) Fi, and performs an instruction for a fuel injection by this fuel injection control routine.

When the crank angle of an arbitrary cylinder reaches the predetermined crank angle, the CPU starts a process from step 400, and determines whether or not a value of a fuel cut flag XFC is "0" at step 405. The value of the fuel cut flag XFC is set to "1" when a fuel cut start condition becomes satisfied, and is set to "0" when a fuel cut end condition becomes satisfied while the value of the fuel cut flag XFC is "1." The value of the fuel cut flag XFC is set to "0" in an initial routine. The initial routine is a routine executed by the CPU when an ignition key switch of the vehicle on which the engine 10 is mounted is turned from off to on.

It is now assumed that the value of the fuel cut flag XFC is "0." In this case, the CPU makes a "Yes" determination at step 405 to proceed to step 410, at which the CPU obtains an "amount of air introduced into the fuel injection cylinder (i.e., a cylinder intake air amount) Mc", based on "the intake air amount Ga, the engine rotational speed NE, and a look-up table MapMc(Ga, NE)." The cylinder intake air amount Mc may be estimated based on a well-known air model (model configured in accordance with physical laws expressing a behavior of the air in the intake passage).

Subsequently, the CPU proceeds to step 415 to determine whether or not a value of the feedback control flag XFB is "1." The value of the feedback control flag XFB is set to "1" when a feedback control condition is satisfied, and to "0" when the feedback control condition is not satisfied. The feedback control condition is satisfied, when all of the following conditions are satisfied.

(A1) The upstream air-fuel ratio sensor 66 has been activated.

(A2) The downstream air-fuel ratio sensor 67 has been activated.

(A3) The load KL of the engine is equal to or lower than a threshold KLth.

(A4) The value of the fuel cut flag XFC is "0."

It should be noted that the load KL is a loading rate (filling rate) KL in the present example, and is obtained according to a formula (1) described below. In the formula (1), ρ is an air density (unit is (g/l), L is a displacement of the engine 10 (unit is (l)), and 4 is the number of cylinders of the engine 10. It should be noted that the load KL may be replaced with the cylinder intake air amount Mc, the throttle valve opening TA, the accelerator pedal operation amount Accp, or the like.

$$KL=(Mc/(\rho\cdot L/4))\cdot 100(\%) \quad (1)$$

When the value of the feedback control flag XFB is not "1", the CPU makes a "No" determination at step 415 to proceed to step 420, at which the CPU sets the target air-fuel ratio abyfr to the stoichiometric air-fuel ratio stoich (e.g., 14.6).

Subsequently, the CPU sequentially executes processes from step 425 to step 440, and proceeds to step 495 to end the present routine tentatively.

Step 425: the CPU calculates a base fuel injection amount Fbase by dividing the cylinder intake air amount Mc by the target air-fuel ratio abyfr. The base fuel injection amount Fbase is a feed forward amount of the fuel injection amount which is necessary to have the air-fuel ratio of the engine become equal to the target air-fuel ratio abyfr.

Step 430: the CPU reads out a main feedback amount KFmain, which has been separately calculated in an unillustrated routine. The main feedback amount KFmain is calculated according to a well known PID control so as to have the detected upstream-side air-fuel ratio abyfs coincide with the target air-fuel ratio abyfr. It should be noted that the main feedback amount KFmain is set to "1" when the value of the feedback control flag XFB is "0." Further, the main feedback amount KFmain may be always set at "1." That is, the feedback control using the main feedback amount KFmain is not requisite in the present embodiment.

Step 435: the CPU calculates the instructed fuel injection amount Fi by correcting the base fuel injection amount Fbase with the main feedback amount KFmain. More specifically, the CPU calculates the instructed fuel injection amount Fi by multiplying the base fuel injection amount Fbase by the main feedback amount KFmain.

Step 440: the CPU sends to the "fuel injection valve 33 for the corresponding fuel injection cylinder" an injection instruction signal to have the "fuel of/having the instructed fuel injection amount Fi" be injected from that "fuel injection valve 33."

As a result, the fuel having an amount which is required to have the air-fuel ratio of the engine coincide with the target air-fuel ratio abyfr is injected from the fuel injection valve 33. That is, the steps from step 425 to step 440 constitute an instructed fuel injection control section which controls the instructed fuel injection amount Fi in such a manner that the air-fuel ratio of the engine becomes equal to the target air-fuel ratio abyfr.

In contrast, when the CPU executes the process of step 415, and if the value of the feedback control flag XFB is "1", the CPU makes a "Yes" determination at step 415 to proceed to step 445, at which the CPU determines whether or not a value of a catalyst lean state indicating flag XCCROLean is "1." The value of the catalyst lean state indicating flag XCCROLean is set in a routine described later.

When the value of the catalyst lean state indicating flag XCCROLean is "1", the CPU makes a "Yes" determination at step 445 to proceed to step 450, at which the CPU sets the target air-fuel ratio abyfr to the "predetermined target rich air-fuel ratio afRich (constant air-fuel ratio smaller than the stoichiometric air-fuel ratio, e.g., 14.2)." Thereafter, the CPU proceeds to steps from step 425. Consequently, the air-fuel ratio of the engine is made to become equal to the target rich air-fuel ratio afRich.

In contrast, when the CPU executes the process of step 445, and if the value of the catalyst lean state indicating flag XCCROLean is "0", the CPU makes a "No" determination at step 445 to proceed to step 455, at which the CPU sets the target air-fuel ratio abyfr to the "predetermined lean air-fuel ratio afLean (constant air-fuel ratio larger than the stoichiometric air-fuel ratio, e.g., 15.0)." Thereafter, the CPU proceeds to steps from step 425. Consequently, the air-fuel ratio of the engine is made to become equal to the target lean air-fuel ratio afLean.

On the other hand, when the CPU executes the process of step 405, and if the value of the fuel cut flag XFC is "1", the CPU makes a "No" determination at step 405 to directly proceed to step 495, at which the CPU ends the present routine tentatively. In this case, since the fuel injection by the process of step 440 is not carried out, the fuel cut control is performed. That is, the operating state of the engine 10 enters the fuel cut operating state.

<Catalyst State Determination>

Figure 5:
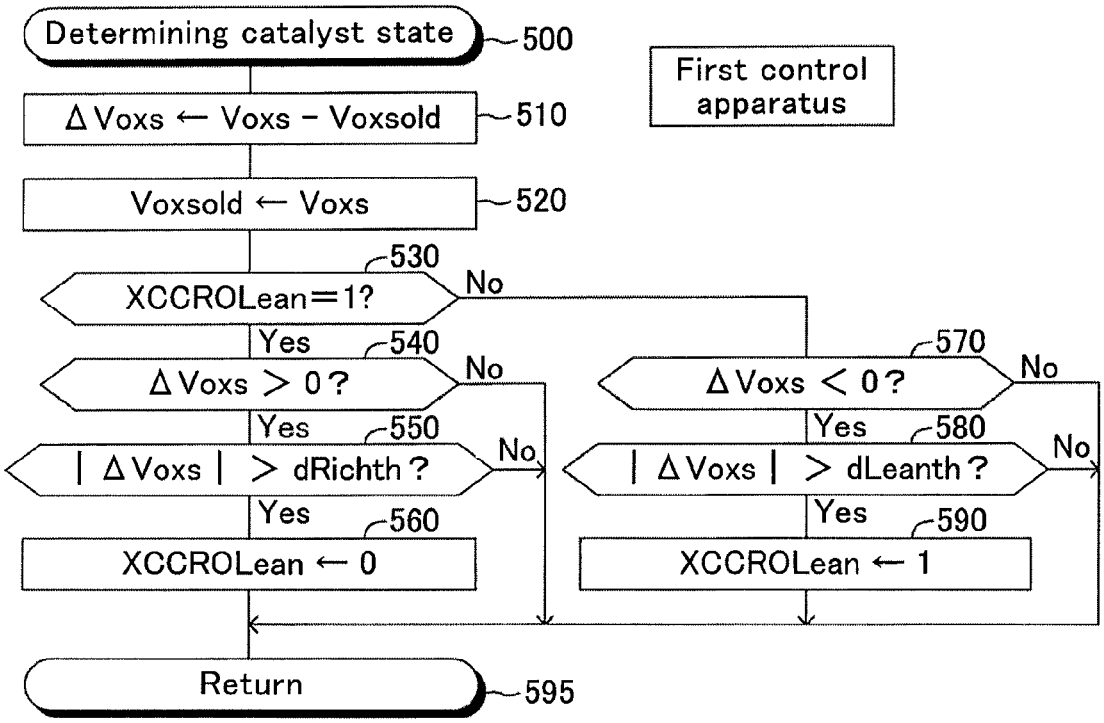
FIG. 5 is a flowchart showing a routine, executed by the CPU of the first control apparatus.

The CPU repeatedly executes a "catalyst state determination routine (requested air-fuel ratio determination routine)" shown by a flowchart in FIG. 5, every time a predetermined time period is elapses. Accordingly, at an appropriate predetermined point in time, the CPU starts the process from step 500 to proceed to step 510, at which the CPU calculates the change amount ΔVoxs of the output value Voxs per the predetermined time (unit time) ts by subtracting a "previous output value Voxsold of the downstream air-fuel ratio sensor 67" from a "present output value Vox of the downstream air-fuel ratio sensor 67." The previous value Voxsold is a value which is updated at next step 520, and is the output value Voxs the predetermined time period ts before the present point in time (output value Voxs when the present routine was previously executed). The change amount ΔVoxs is also referred to as a change speed ΔVoxs. Subsequently, the CPU proceeds to step 520 to store the output value Voxs at the present point in time as the "previous output value Voxsold."

Subsequently, the CPU proceeds to step 530 to determine whether or not the value of the catalyst lean state indicating flag XCCROLean is "1." The value of the catalyst lean state indicating flag XCCROLean is set to "1" in the above described initial routine. Further, as described later, the value of the catalyst lean state indicating flag XCCROLean is set to "0" when it is determined that the state of the catalyst 43 is the oxygen shortage state (rich state) based on the output value Voxs of the downstream air-fuel ratio sensor 67, and is set to "1" when it is determined that the state of the catalyst 43 is the oxygen excessive state (lean state) based on the output value Voxs of the downstream air-fuel ratio sensor 67.

It is now assumed that the value of the catalyst lean state indicating flag XCCROLean is "1." In this case, the CPU makes a "Yes" determination at step 530 to proceed to step 540, at which the CPU determines whether or not the change speed ΔVoxs is positive. That is, the CPU determines whether or not the output value Voxs is increasing. When the change speed ΔVoxs is not positive, the CPU makes a "No" determination at step 540 to directly proceed to step 595, at which the CPU ends the present routine tentatively.

In contrast, when the change speed ΔVoxs is positive, the CPU makes a "Yes" determination at step 540 to proceed to step 550, at which the CPU determines whether or not the magnitude |ΔVoxs| of the change speed ΔVoxs is larger than the rich determining threshold value dRichth. When the magnitude |ΔVoxs| is equal to or smaller than the rich determining threshold value dRichth, the CPU makes a "No" determination at 550 to directly proceed to step 595, at which the CPU ends the present routine tentatively.

When the CPU executes the process of step 550, and if the magnitude |ΔVoxs| of the change speed ΔVoxs is larger than the rich determining threshold value dRichth, the CPU makes a "Yes" determination at step 550 to proceed to step 560, at which the CPU sets the value of the catalyst lean state indicating flag XCCROLean to "0." That is, when the output value Voxs is increasing and the magnitude |ΔVoxs| of the change speed ΔVoxs is larger than the rich determining threshold value dRichth, the CPU determines that "the state of the catalyst 43 is the oxygen shortage state" so as to set the value of the catalyst lean state indicating flag XCCROLean to "0."

In this state (i.e., in the state in which the value of the catalyst lean state indicating flag XCCROLean is set at "0"), and when the CPU again starts to execute the process of step 500, the CPU proceeds to step 530 via step 510 and step 520, and makes a "No" determination at step 530 to proceed to step 570.

At step 570, the CPU determines whether or not the change speed ΔVoxs is negative. That is, the CPU determines whether or not the output value Voxs is decreasing. When the change speed ΔVoxs is not negative, the CPU makes a "No" determination at step 570 to directly proceed to step 595, at which the CPU ends the present routine tentatively.

In contrast, when the change speed ΔVoxs is negative, the CPU makes a "Yes" determination at step 570 to proceed to step 580, at which the CPU determines whether or not the magnitude |ΔVoxs| of the change speed ΔVoxs is larger than the lean determining threshold value dLeanth. When the magnitude |ΔVoxs| is equal to or smaller than the lean determining threshold value dLeanth, the CPU makes a "No" determination at 580 to directly proceed to step 595, at which the CPU ends the present routine tentatively.

When the magnitude |ΔVoxs| of the change speed ΔVoxs is larger than the lean determining threshold value dLeanth, the CPU makes a "Yes" determination at step 580 to proceed to step 590, at which the CPU sets the value of the catalyst lean state indicating flag XCCROLean to "1." That is, when the output value Voxs is decreasing and the magnitude |ΔVoxs| of the change speed ΔVoxs is larger than the lean determining threshold value dLeanth, the CPU determines that "the state of the catalyst 43 is the oxygen excessive state" so as to set the value of the catalyst lean state indicating flag XCCROLean to "1."

It should be noted that the CPU may set the value of the catalyst lean state indicating flag XCCROLean to "0" when the value of the catalyst lean state indicating flag XCCROLean is "1" and the output value Voxs becomes larger than the rich determining threshold value VRichth. Similarly, the CPU may set the value of the catalyst lean state indicating flag XCCROLean to "1" when the value of the catalyst lean state indicating flag XCCROLean is "0" and the output value Voxs becomes smaller than the lean determining threshold value VLeanth. In this case, the rich determining threshold value VRichth may be a value equal to or smaller than the middle value Vmid. The lean determining threshold value VLeanth may be equal to or larger than the middle value Vmid.

In this manner, the value of the catalyst lean state indicating flag XCCROLean is alternately set to "1" and "0", based on the output value Voxs of the downstream air-fuel ratio sensor 67. Thereafter, the target air-fuel ratio abyrf is determined based on the catalyst lean state indicating flag XCCROLean (refer to steps from step 445 to step 455, shown in FIG. 4), and the instructed fuel injection amount Fi is determined based on the target air-fuel ratio (refer to steps from step 425 to step 435, shown in FIG. 4).

<Evaporated Fuel Purge Start Control>

Figure 6:
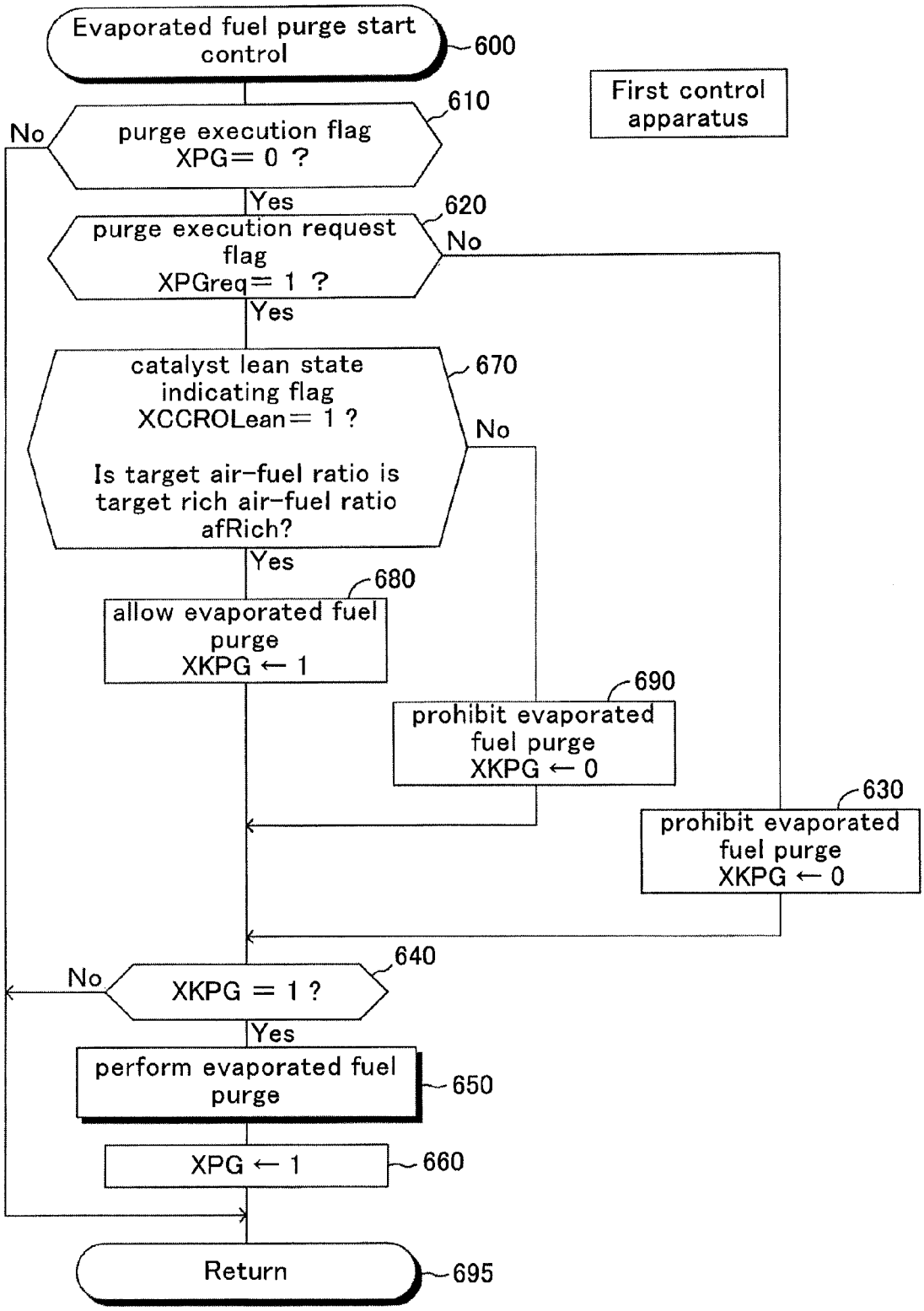
FIG. 6 is a flowchart showing a routine, executed by the CPU of the first control apparatus.

The CPU repeatedly executes an evaporated fuel purge start control routine shown by a flowchart in FIG. 6, every time a predetermined time period elapses. Accordingly, at an appropriate predetermined point in time, the CPU starts the process from step 600 to proceed to step 610, at which the CPU determines whether or not a value of a purge execution flag XPG is "0." The value of the purge execution flag is set to "1" when the purge control valve 55 is opened so that the evaporated fuel is introduced into the intake passage (when the evaporated fuel purge is being performed), and is set to "0" when the purge control valve 55 is closed so that the evaporated fuel is not introduced into the intake passage (when the evaporated fuel purge is not being performed). Further, the value of the purge execution flag is set to "0" in the above described initial routine.

It is now assumed that the evaporated fuel purge is not being performed, and thus, the value of the purge execution flag is set to "0." In this case, the CPU makes a "Yes" determination at step 610 to proceed to step 620 to determine whether or not a value of a purge execution request flag XPGreq is "1."

The value of the purge execution request flag XPGreq is set to "1" when the purge execution request condition is satisfied, and is set to "0" when the purge execution request condition is not satisfied. Further, the value of the purge execution request flag XPGreq is set to "0" in the above described initial routine.

The purge execution request condition is satisfied, for example, when all of the following conditions are satisfied. Another conditions may be added to the purge execution request condition.

(B1) the value of the feedback control flag XFB is "1" (when the main feedback control is being executed), (B2) the engine 10 is stably being operated (e.g., a change amount of the throttle valve opening TA per unit time, representing the load of the engine, is equal to or smaller than a predetermined value), (B3) the cooling water temperature THW is equal to or higher than a cooling water temperature threshold THWth.

It is now assumed that the purge execution request condition is not satisfied, and thus, the value of the purge execution request flag XPGreq is "0." In this case, the CPU makes a "No" determination at step 620 to proceed to step 630 to set the value of a purge allowance flag XKPG is set to "0." It should be noted that the value of the purge allowance flag XKPG is set to "0" in the above described initial routine.

Subsequently, the CPU proceeds to step 640 to determine whether or not the value of the purge allowance flag XKPG is "1." In this case, the value of the purge allowance flag XKPG is set to "0." Accordingly, the CPU makes a "No" determination at step 640 to directly proceed to step 695, at which the CPU ends the present routine tentatively. Consequently, the evaporated fuel purge is not carried out.

In this state, when the purge execution request condition becomes satisfied, the value of the purge execution request flag XPGreq is set to "1" in an unillustrated routine. In this case, the CPU makes a "Yes" determination at step 620 which follows step 610 to proceed to step 670, at which the CPU determines whether or not the value of the catalyst lean state indicating flag XCCROLean is "1." In other words, the CPU determines whether or not the target air-fuel ratio abyfr at the present point in time is the target rich air-fuel ratio afRich.

It is now assumed that the value of the catalyst lean state indicating flag XCCROLean is "1." In this case, the CPU makes a "Yes" determination at step 670 to proceed to step 680 to set the value of the purge allowance flag XKPG to "1." Subsequently, the CPU determines whether or not the value of the purge allowance flag XKPG is "1."

In this case, the CPU makes a "Yes" determination at step 640 to proceed to step 650 to open the purge control valve 55 so as to have the evaporated fuel be introduced into the intake passage. That is, the CPU starts the evaporated fuel purge. It should be noted that, in actuality, the CPU sends the signal having the duty ratio DPG to the purge control valve 55. The duty ratio DPG is determined based on, for example, the intake air amount Ga and the engine rotational speed NE. Subsequently, the CPU proceeds to step 660 to set the value of the purge execution flag XPG to "1", and then, proceeds to step 695 to end the present routine tentatively. Accordingly, when the CPU starts the process of the routine shown in FIG. 6 from step 600, the CPU makes a "No" determination at step 610 to directly proceed to step 695 to end the present routine tentatively.

In this manner, if the value of the catalyst lean state indicating flag XCCROLean is "1" (that is, the target air-fuel ratio abyfr is the target rich air-fuel ratio afRich) at the purge execution request condition satisfied time point at which the value of the purge execution request flag XPGreq is changed from "0" to "1", the evaporated fuel purge is immediately started.

In contrast, when the CPU executes the process of step 670, and if the value of the catalyst lean state indicating flag XCCROLean is "0", the CPU makes a "No" determination at step 670 to proceed to step 690 to set the value of the purge allowance flag XKPG to "0." In this case, the CPU makes a "No" determination at step 640 to directly proceed to step 695 to end the present routine tentatively. Therefore, if the value of the catalyst lean state indicating flag XCCROLean is not "1" (i.e., if the target air-fuel ratio abyfr is the target lean air-fuel ratio afLean) at the purge execution request condition satisfied time point, the evaporated fuel is not started. Thereafter, when the value of the catalyst lean state indicating flag XCCROLean is set to "1", the CPU makes a "Yes" determination at step 670 to proceed to step 680 so that the evaporated fuel purge is started.

<Evaporated Fuel Purge End Control>

Figure 7:
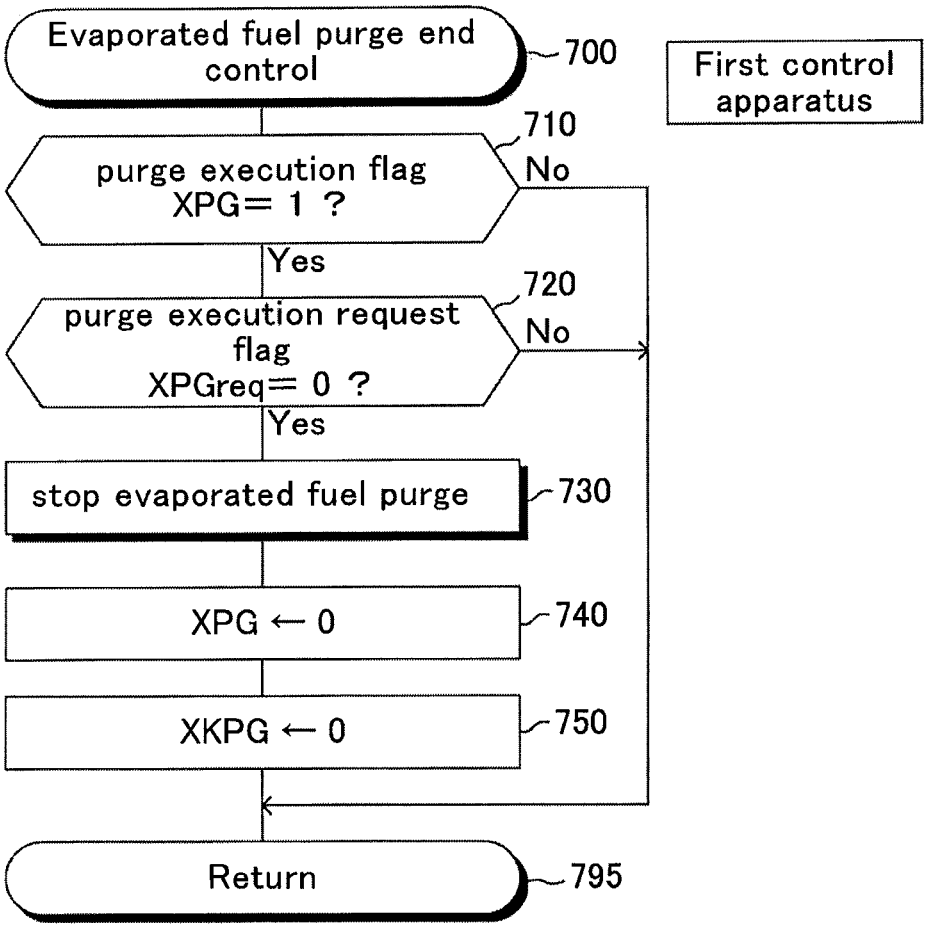
FIG. 7 is a flowchart showing a routine, executed by the CPU of the first control apparatus.

The CPU repeatedly executes an evaporated fuel purge end control routine shown by a flowchart in FIG. 7, every time a predetermined time period elapses. Accordingly, at an appropriate predetermined point in time, the CPU starts the process from step 700 to proceed to step 710, at which the CPU determines whether or not the value of the purge execution flag XPG is "1."

It is now assumed that the evaporated fuel purge has been started, and thus, the value of the purge execution flag XPG was set to "1" at step 600 shown in FIG. 6, the CPU makes a "Yes" determination at step 710 to proceed to step 720, at which the CPU determines whether or not the value of the purge execution request flag XPGreq is "0." When the value of the purge execution request flag XPGreq is "1", the CPU makes a "Yes" determination at step 720 to directly proceed to step 795 to end the present routine tentatively. Accordingly, the evaporated fuel purge continues to be carried out.

In contrast, when the CPU executes the process of step 720, and if the purge execution request condition is unsatisfied so that the value of the purge execution request flag XPGreq is set at "0", the CPU makes a "Yes" determination at step 720 to sequentially executes the processes from step 730 to step 750, and thereafter, proceeds to step 795 to end the present routine tentatively.

Step 730: the CPU closes the purge control valve 55 (sets the duty ratio DPG to "0"). That is, the CPU terminates/ends the evaporated fuel purge.

Step 740: the CPU sets the value of the purge execution flag XPG to "0.".

Step 750: the CPU sets the value of the purge allowance flag XKPG to "0.".

Consequently, when the CPU executes the process of step 710, the CPU makes a "No" determination at step 710 to directly proceed to step 795, at which the CPU ends the present routine tentatively.

As described above, the first control apparatus is a control apparatus for an internal combustion engine comprising:

a target air-fuel ratio determining section configured to determine, based on the output value Voxs of the downstream air-fuel ratio sensor 67, which the target value (target air-fuel ratio abyfr) of the air-fuel ratio of the gas flowing into the catalyst 43 is set to, the "target rich air-fuel ratio afRich smaller than the stoichiometric air-fuel ratio" or the "target lean air-fuel ratio afLean larger than the stoichiometric air-fuel ratio" (refer to the routine shown in FIG. 5, and steps from step 445 to step 455 shown in FIG. 4);

a fuel injection control section configured to determine an amount (fuel injection amount) of the fuel to be injected from the fuel injection valve 33 in accordance with the target air-fuel ratio abyfr, and to have the fuel having the determined fuel injection amount be injected from the fuel injection valve 33 (refer to steps from step 425 to step 440, shown in FIG. 4); and an evaporated fuel purge section configured to perform/execute the evaporated fuel purge to introduce, into an intake passage of the engine, the evaporated fuel generated in the fuel tank 51 which stores the fuel to be supplied to the fuel injection valve 33, when the "predetermined purge execution request condition" is satisfied (refer to the evaporated fuel purge system 50, the routine shown in FIG. 6, and the routine shown in FIG. 7).

Further, the evaporated fuel purge section is configured:

so as to start the evaporated fuel purge when the target air-fuel ratio abyfr is set at the target rich air-fuel ratio afRich at the purge execution request condition satisfied time point at which a state changes from a state in which the purge execution request condition is unsatisfied to a state in which the purge execution request condition is satisfied (refer to step 620, step 670, step 680, step 640, and step 650, shown in FIG. 6); and so as not to start the evaporated fuel purge when the target air-fuel ratio abyfr is set at the target lean air-fuel ratio afLean at the purge execution request condition satisfied time point (refer to step 670, step 690, and step 640, shown in FIG. 6), and so as to thereafter start the evaporated fuel purge when the target air-fuel ratio abyfr is set at the target rich air-fuel ratio afRich after a point in time at which the target air-fuel ratio was changed to the target rich air-fuel ratio afRich (step 620, step 670, step 680, step 640, and step 650, shown in FIG. 6).

According to the first control apparatus, the target air-fuel ratio abyfr when the evaporated fuel purge is started is the target rich air-fuel ratio afRich and is not the target lean air-fuel ratio afLean, and thus, the state of the catalyst 43 when the evaporated fuel purge is started is the "oxygen excessive state (lean state)." In other words, the evaporated fuel purge is started when the catalyst 43 is in the state in which the catalyst 43 can purify a lot of unburnt substance. Accordingly, even if a large amount of unburnt substance flows into the catalysts 43 due to the start of the evaporated fuel gas, the catalyst 43 can purify a large part of the unburnt substance. Consequently, the degree of degrading the emission at the start of the evaporated fuel purge can be reduced.

Second Embodiment

Next will be described a control apparatus for an internal combustion engine according to a second embodiment of the present invention (hereinafter, referred to as a "second control apparatus").

The second control apparatus is different from the first control apparatus only in that the second control apparatus changes/switches over the condition to start the evaporated fuel purge, based on whether the state of the engine 10 at the purge execution request condition satisfied time point is a first operating state in which the emission is prioritized, or a second operating state in which the drivability is prioritized.

(Actual Operation)

The CPU of the second control apparatus executes the routines executed by the CPU of the first control apparatus, except the routine shown in FIG. 6. Further, the CPU of the second control apparatus executes an "evaporated fuel purge start control routine shown in FIG. 8 in place of FIG. 6" every time the predetermined time period elapses. Thus, operations of the second control apparatus will be described in mainly reference to FIG. 8, hereinafter.

Figure 8:
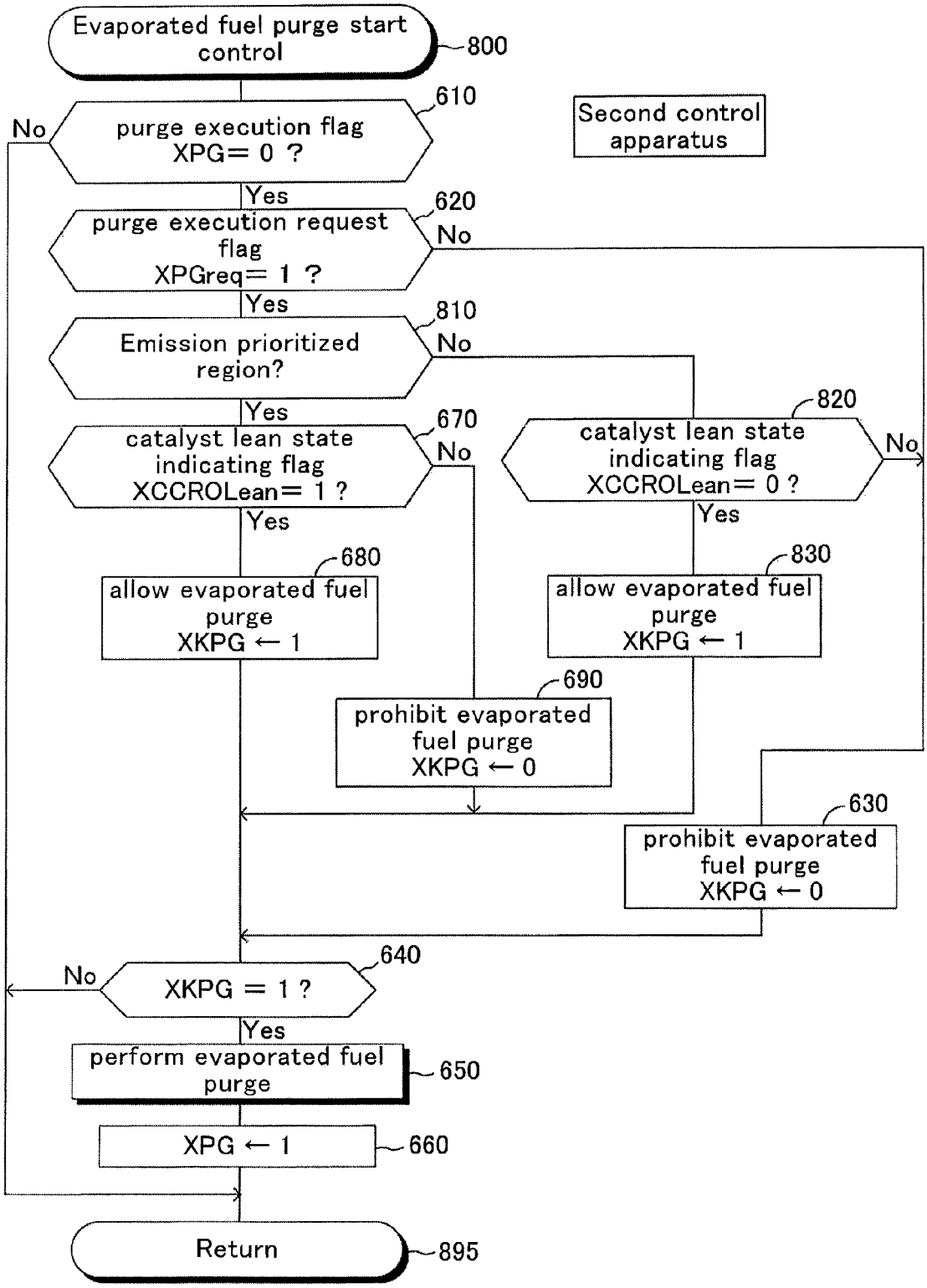
FIG. 8 is a flowchart showing a routine, executed by a CPU of a control apparatus (second control apparatus) according to a second embodiment of the present invention.

The routine shown in FIG. 8 is similar to the routine shown in FIG. 6. Each step shown in FIG. 8 which is also shown in FIG. 6 is given the same numeral as one given to such step shown in FIG. 6. Detail descriptions for those steps may be appropriately omitted. The routine shown in FIG. 8 is different from the routine shown in FIG. 6 only in that steps from step 810 to step 830 are added to the routine shown in FIG. 6. Those differences will be described, hereinafter.

When the value of the purge execution flag XPG is "0" (when the evaporated fuel purge is not being performed), and the value of the purge execution request flag XPGreq is set to "1" (purge execution request condition satisfied time point), the CPU makes "Yes" determinations at both step 610 and step 620 to proceed to step 810, at which the CPU determines whether the operating state of the engine 10 is in an operating region in which the emission should be prioritized. When the operating state of the engine 10 is in the operating region in which the emission should be prioritized, it is expressed that the operating state of the engine 10 is the first operating state.

Figure 9:
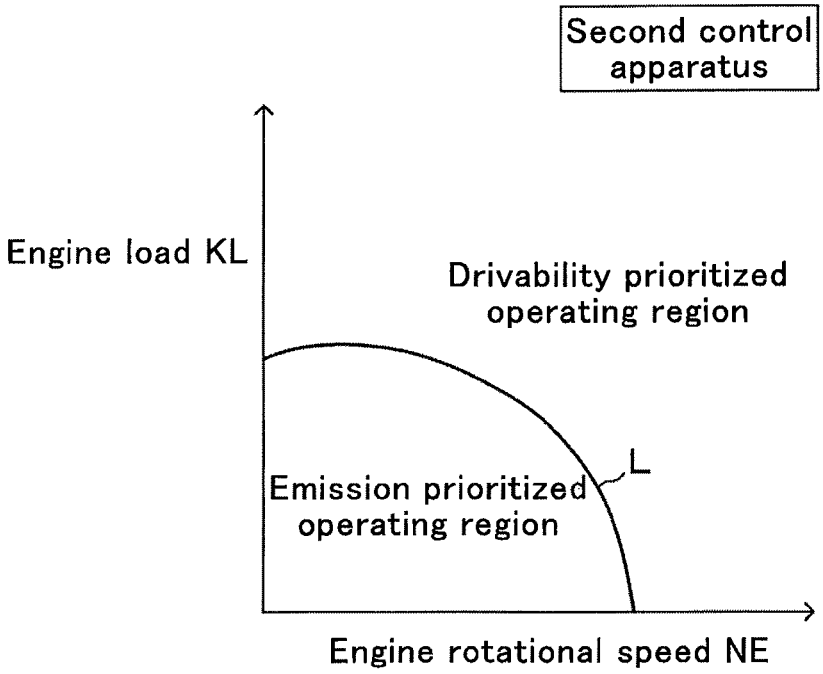
FIG. 9 is a map defining operating regions, to which the CPU of the second control apparatus refer.

More specifically, when the CPU proceeds to step 810, the CPU determines which the operating state of the engine 10 represented by the load KL and the engine rotational speed NE is in, "an emission priority region or a drivability priority region" shown by an operating region map in FIG. 9. The emission priority region is a region in a low load side and low rotational speed side when an entire operating region is divided into two regions with a "boundary line L defining a relationship between the load and the engine rotational speed." The drivability priority region is a region in a high load side and high rotational speed side of the divided two region.

It is now assumed that the operating state of the engine 10 is the emission priority region. In this case, the CPU makes a "Yes" determination at step 810 to proceed to steps from step 670. Accordingly, the CPU immediately starts the evaporated fuel purge if the value of the catalyst lean state indicating flag XCCROLean is "1" (refer to step 680, step 640, and step 650), and does not start the evaporated fuel purge if the value of the catalyst lean state indicating flag XCCROLean is "0" (refer to step 690, and step 640).

In contrast, when the CPU executes the process of step 810, and if the operating state of the engine 10 is not the emission priority region (that is, when the operating state of the engine 10 is the drivability priority region, in other words, the operating state of the engine 10 is the second operating state), the CPU makes a "No" determination at step 810 to proceed to step 820.

The CPU determines whether or not the value of the catalyst lean state indicating flag XCCROLean is "0." When the value of the catalyst lean state indicating flag XCCROLean is "0", the CPU makes a "Yes" determination at step 820 to proceed to step 830, at which the CPU sets the value of the purge allowance flag XKPG to "1." Thereafter, the CPU proceeds steps from step 640. As a result, when the operating state of the engine 10 is the drivability priority region, the evaporated fuel purge is started if the target air-fuel ratio abyfr is the target lean air-fuel ratio afLean.

In contrast, when the CPU executes the process of step 820, and if the value of the catalyst lean state indicating flag XCCROLean is "1", and thus, the target air-fuel ratio abyfr is the target rich air-fuel ratio afRich, the CPU makes a "No" determination at step 820 to proceed to step 630, at which the CPU sets the value of the purge allowance flag XKPG to "0." Thereafter, the CPU proceeds steps from step 640. As a result, the evaporated fuel purge is not started.

As described above, in the case in which the operating state of the engine 10 at the purge execution request condition satisfied time point is the first operating state (refer to the "Yes" determination at step 810 shown in FIG. 8), the evaporated fuel purge section of the second control apparatus starts the evaporated fuel purge when the target air-fuel ratio abyfr is set at the target rich air-fuel ratio afRich (refer to step 670 and step 680, shown in FIG. 8), and does not start the evaporated fuel purge when the target air-fuel ratio abyfr is set at the target lean air-fuel ratio afLean (refer to step 670 and step 690, shown in FIG. 8). Further, in this case, the evaporated fuel purge section starts the evaporated fuel purge when the target air-fuel ratio abyfr is set at the target rich air-fuel ratio afRich after the target air-fuel ratio abyfr is set/changed to the target rich air-fuel ratio afRich (refer to step 670 and step 680, shown in FIG. 8).

According to the above configuration, the evaporated fuel purge is started when the state of the catalyst 43 is in the oxygen excessive state. Therefore, even if a large amount of the unburnt substance flows into the catalyst 43 when the evaporated fuel purge is started, the catalyst 43 can purify the large part of the unburnt substance. Consequently, when the operating state of the engine 10 is the "first operating state in which the emission should be prioritized", the degree of degrading the emission at the start of the evaporated fuel purge can be reduced.

Further, in the case in which the operating state of the engine 10 at the purge execution request condition satisfied time point is the "second operating state different from the first operating state" (refer to the "No" determination at step 810 shown in FIG. 8), the evaporated fuel purge section starts the evaporated fuel purge when the target air-fuel ratio abyfr is set at the target lean air-fuel ratio afLean (refer to step 820 and step 830, shown in FIG. 8), and does not start the evaporated fuel purge when the target air-fuel ratio abyfr is set at the target rich air-fuel ratio afRich (refer to step 820 and step 630, shown in FIG. 8). Further, in this case, the evaporated fuel purge section starts the evaporated fuel purge when the target air-fuel ratio abyfr is set at the target lean air-fuel ratio afLean after the target air-fuel ratio abyfr is set/changed to the target lean air-fuel ratio afLean (refer to step 820, and step 830 shown in FIG. 8).

The evaporated fuel is additionally supplied to the engine 10 immediately after the start of the evaporated fuel purge, and thus, the air-fuel ratio of the engine 10 temporarily becomes small. Thus, if the evaporated fuel purge is started when the target air-fuel ratio abyfr is the target rich air-fuel ratio afRich, the air-fuel ratio of the engine becomes excessively small. As a result, a vibration of the engine 10 may occur due to an unstable combustion of the mixture, and the like, and thus, the drivability (running performance) of the engine 10 or of the vehicle on which the engine 10 is mounted may become degraded.

In contrast, according to the second control apparatus, in the case in which the operating state of the engine 10 is the "second operating state in which the drivability of the engine 10 or of the vehicle on which the engine 10 is mounted should be prioritized", the evaporated fuel purge is started when the target air-fuel ratio abyfr is the target lean air-fuel ratio afLean. Therefore, the air-fuel ratio of the engine is made come closer to the stoichiometric air-fuel ratio owing to the start of the evaporated fuel purge. Consequently, the combustion state of the mixture becomes stable, and therefore, the drivability (running performance) of the engine 10 or of the vehicle on which the engine 10 is mounted can be improved.

Meanwhile, in the case in which the operating state of the engine 10 is the second operating state, the evaporated fuel purge is started when the state of the catalyst 43 is the "oxygen shortage state (rich state)." Accordingly, there may be a possibility that the emission becomes degraded, however, the second operating state is the state in which the load and/or the engine rotational speed are high, and thus, a temperature of the catalyst 43 is high at the start of the evaporated fuel purge so that the purifying capacity of the catalyst 43 is high, as compared with the first operating state. Therefore, the possibility that the emission becomes extremely degraded due to the start of the evaporated fuel purge is low. In addition, the engine 10 comprises the downstream-side catalyst at the position downstream of that catalyst 43. When the operating state of the engine 10 is the second operating state, a temperature of the downstream-side catalyst reaches a certain high temperature. Accordingly, the unburnt substance is also purified by the downstream-side catalyst. Thus, the possibility that the emission becomes extremely degraded due to the start of the evaporated fuel purge is very low.

It should be noted that the first operating state in which the emission should be prioritized may be a low load operating state (that is, a state in which the load KL is equal to or lower than a load threshold KLth), and the second operating state in which the drivability should be prioritized may be a high load operating state (that is, a state in which the load KL is larger than the load threshold KLth). Further, the first operating state may be a low rotational speed operating state (that is, a state in which the engine rotational speed NE is equal to or lower than an engine rotational speed threshold NEth), and the second operating state may be a high rotational speed operating state (that is, a state in which the engine rotational speed NE is higher than the engine rotational speed threshold NEth).

Third Embodiment

Next will be described a control apparatus according to a third embodiment of the present invention (hereinafter, referred to as a "third control apparatus"). The third control apparatus is different from the second control apparatus only in "different points 1 and 2" described below.

(The Different Point 1)

Similarly to the second control apparatus, in the case in which the operating state at the purge execution request condition satisfied time point is the first operating state (in which the emission should be prioritized), the third control apparatus starts the evaporated fuel purge when the target air-fuel ratio abyfr is the target rich air-fuel ratio afRich. Note that, however, even if the operating state at the purge execution request condition satisfied time point is the first operating state and the target air-fuel ratio at that point in time is the target rich air-fuel ratio afRich, the third control apparatus estimates a time period (first time period) from that point in time to a "point in time at which the target air-fuel ratio abyfr is changed to the target lean air-fuel ratio afLean", and does not start the evaporated fuel purge if the estimated first time period is equal to or shorter than a first threshold time period. In other words, the third control apparatus starts the evaporated fuel purge when the estimated first time period is longer than the first threshold time period.

(The Different Point 2)

Similarly to the second control apparatus, in the case in which the operating state at the purge execution request condition satisfied time point is the second operating state (in which the drivability should be prioritized), the third control apparatus starts the evaporated fuel purge when the target air-fuel ratio abyfr is the target lean air-fuel ratio afLean. Note that, however, even if the operating state at the purge execution request condition satisfied time point is the second operating state and the target air-fuel ratio at that point in time is the target lean air-fuel ratio afLean, the third control apparatus estimates a time period (second time period) from that point in time to a "point in time at which the target air-fuel ratio abyfr is changed to the target rich air-fuel ratio afRich", and does not start the evaporated fuel purge if the estimated second time period is equal to or shorter than a predetermined second threshold time period. In other words, the third control apparatus starts the evaporated fuel purge when the estimated second time period is longer than the second threshold time period.

(Actual Operation)

The CPU of the third control apparatus executes the routines executed by the CPU of the second control apparatus, except the routine shown in FIG. 8. Further, the CPU of the third control apparatus executes an "evaporated fuel purge start control routine shown in FIG. 10 in place of FIG. 8" every time the predetermined time period elapses. Thus, operations of the third control apparatus will be described in mainly reference to FIG. 10, hereinafter.

Figure 10:
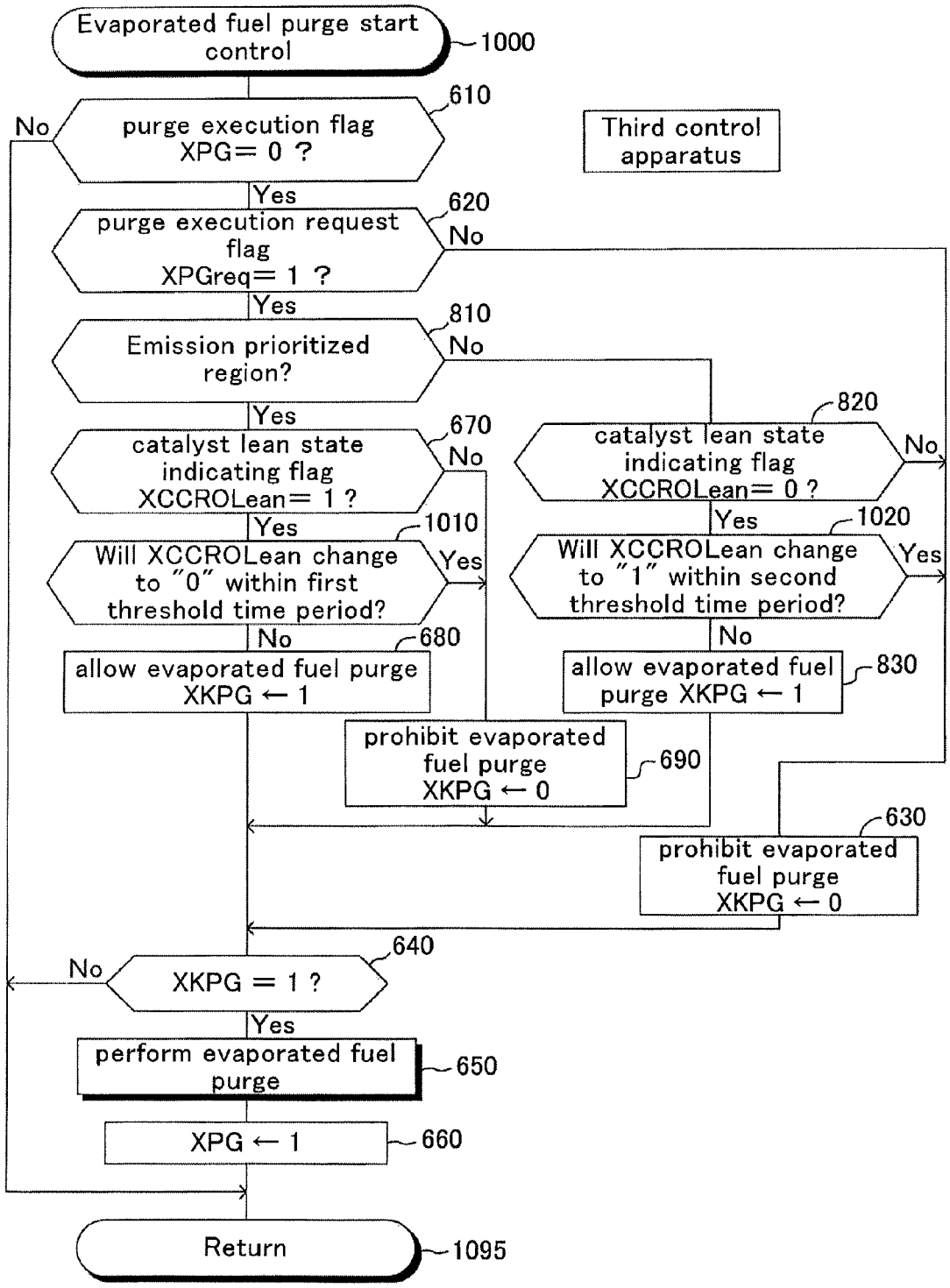
FIG. 10 is a flowchart showing a routine, executed by a CPU of a control apparatus (third control apparatus) according to a third embodiment of the present invention.

The routine shown in FIG. 10 is similar to the routine shown in FIG. 8. Each step shown in FIG. 10 which is also shown in FIG. 8 is given the same numeral as one given to such step shown in FIG. 8. Detail descriptions for those steps may be appropriately omitted. The routine shown in FIG. 10 is different from the routine shown in FIG. 8 only in that step 1010 and step 1020 are added to the routine shown in FIG. 8. Those differences will be described, hereinafter.

When the value of the purge execution flag XPG is "0" (when the evaporated fuel purge is not being carried out), and when the value of the purge execution request flag XPGreq is set to "1" (purge execution request condition satisfied time point), the CPU makes "Yes" determinations at both step 610 and step 620 to proceed to step 810. When the operating state of the engine 10 is in the region in which the emission should be prioritized, the CPU makes a "Yes" determination at step 810 to proceed to step 670, at which the CPU determines whether or not the value of the catalyst lean state indicating flag XCCROLean is "1."

When the value of the catalyst lean state indicating flag XCCROLean is "1", the CPU makes a "Yes" determination at step 670 to proceed to step 1010, at which the CPU executes the following process.

The CPU estimates the time period (first time period T1) from the "present point in time" to the "point in time at which the target air-fuel ratio abyfr is (will be) changed to the target lean air-fuel ratio afLean." The method for estimating the first time period T1 will be described later. The first time period T1 is also a time period from the "present point in time" to a "point in time at which the value of the catalyst lean state indicating flag XCCROLean is (will be) changed to "0"."

The CPU determines whether or not the first time period T1 is equal to or shorter than (within) the first threshold time period T1th.

When the first time period T1 is equal to or shorter than (within) the first threshold time period T1th, the CPU makes a "Yes" determination at step 1010 to proceed to step 690, at which the CPU sets the value of the purge allowance flag XKPG to "0." Accordingly, the evaporated fuel purge is not started in this case.

In contrast, when the CPU executes the process of step 1010, and if the first time period T1 is not equal to or shorter than (within) the first threshold time period T1th, the CPU makes a "No" determination at step 1010 to proceed to step 680, at which the CPU sets the value of the purge allowance flag XKPG to "1." As a result, the evaporated fuel purge is started. That is, the CPU starts the evaporated fuel purge, when the first time period T1 is longer the first threshold time period T1th (i.e., when the change of the target air-fuel ratio abyfr to the target lean air-fuel ratio afLean does not occur within the first threshold time period T1th).

In contrast, when the value of the purge execution flag XPG is "0" (the evaporated fuel purge is not being performed), and the value of the purge execution request flag XPGreq is set to "1" (purge execution request condition satisfied time point), and if the operating state of the engine 10 is not in the region in which the emission should be prioritized (the drivability should be prioritized), the CPU makes a "No" determination at step 810 to proceed to step 820, at which the CPU determines whether or not the value of the catalyst lean state indicating flag XCCROLean is "0."

When the value of the catalyst lean state indicating flag XCCROLean is "0", the CPU makes a "Yes" determination at step 820 to proceed to step 1020, at which the CPU executes the following process.

The CPU estimates the time period (second time period T2) from the "present point in time" to the "point in time at which the target air-fuel ratio abyfr is (will be) changed to the target rich air-fuel ratio afRich." The method for estimating the second time period T2 will be described later. The second time period T2 is also a time period from the "present point in time" to a "point in time at which the value of the catalyst lean state indicating flag XCCROLean is (will be) changed to "1"."

The CPU determines whether or not the second time period T2 is equal to or shorter than (within) the second threshold time period T2th.

When the second time period T2 is equal to or shorter than (within) the second threshold time period T2th, the CPU makes a "Yes" determination at step 1020 to proceed to step 630, at which the CPU sets the value of the purge allowance flag XKPG to "0." Accordingly, the evaporated fuel purge is not started in this case.

In contrast, when the CPU executes the process of step 1020, and if the second time period T2 is not equal to or shorter than (within) the second threshold time period T2th, the CPU makes a "No" determination at step 1020 to proceed to step 830, at which the CPU sets the value of the purge allowance flag XKPG to "1." As a result, the evaporated fuel purge is started. That is, the CPU starts the evaporated fuel purge, when the second time period T2 is longer the second threshold time period T2th (i.e., when the change of the target air-fuel ratio abyfr to the target rich air-fuel ratio afRich does not occur within the second threshold time period T2th).

Figure 11:
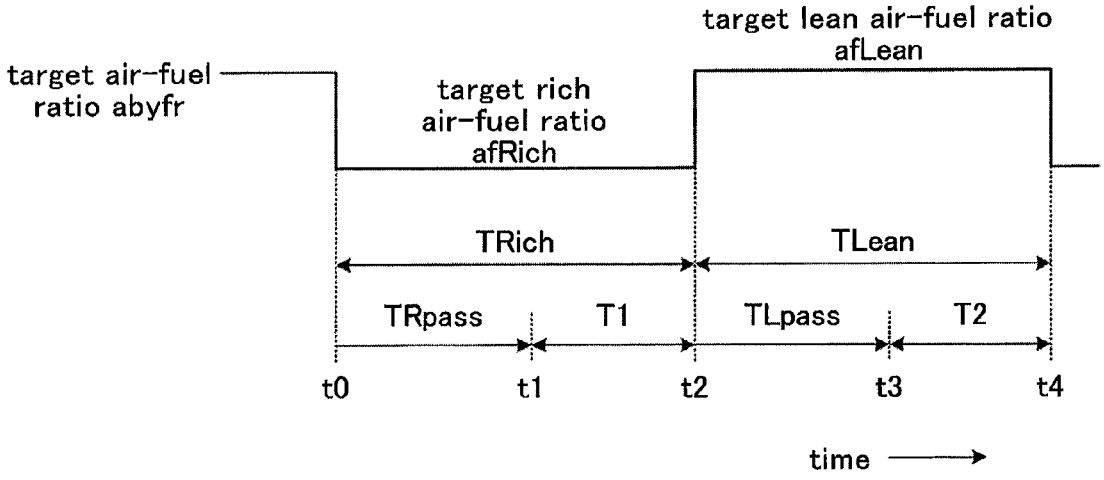
FIG. 11 is a timeline chart for describing a method for estimating a first time period and a second time period.

Subsequently, the method for estimating the first and second time period will be described in reference to FIG. 11.

The CPU measures an elapsed time period (target rich air-fuel ratio elapsed time period) TRpass in which the target rich air-fuel ratio afRich has been continued to be set as the target air-fuel ratio abyfr from a point in time (refer to time t0) at which the target air-fuel ratio abyfr was changed from the target lean air-fuel ratio afLean to the target rich air-fuel ratio afRich.

Further, at the time t0, the CPU estimates a duration time TRich of the present target rich air-fuel ratio afRich. More specifically, the third control apparatus stores/memorizes, in the ROM, a look-up table MapTRich(Ga, NE) defining a relationship between "the intake air amount Ga and the engine rotational speed NE" and the duration time TRich of the target rich air-fuel ratio. This table MapTRich(Ga, NE) is formed based on data obtained in advance by experiments. At time t0, the CPU applies "the intake air amount Ga and the engine rotational speed NE" at time t0 to the table MapTRich (Ga, NE) so as to estimate the duration time TRich of the target rich air-fuel ratio.

Further, it is assumed that the process of step 1010 shown in FIG. 10 is executed, at time t1. At this point in time, the CPU estimates (obtains) the above first time period T1 (time period until the target air-fuel ratio abyfr is switched over to the target lean air-fuel ratio afLean) by subtracting the target rich air-fuel ratio elapsed time period TRpass from the duration time TRich of the target rich air-fuel ratio.

Similarly, the CPU measures an elapsed time period (target lean air-fuel ratio elapsed time period) TLpass in which the target lean air-fuel ratio afLean has been continued to be set as the target air-fuel ratio abyfr from a point in time (refer to time t2) at which the target air-fuel ratio abyfr was changed from the target rich air-fuel ratio afRich to the target lean air-fuel ratio afLean.

Further, at the time t2, the CPU estimates a duration time TLean of the present target lean air-fuel ratio afLean. More specifically, the third control apparatus stores/memorizes, in the ROM, a look-up table MapTLean(Ga, NE) defining a relationship between "the intake air amount Ga and the engine rotational speed NE" and the duration time TLean of the target lean air-fuel ratio. This table MapTLean(Ga, NE) is formed based on data obtained in advance by experiments. At time t2, the CPU applies "the intake air amount Ga and the engine rotational speed NE" at time t2 to the table MapTLean (Ga, NE) so as to estimate the duration time TLean of the target lean air-fuel ratio.

Further, it is assumed that the process of step 1020 shown in FIG. 10 is executed, at time t3. At this point in time, the CPU estimates (obtains) the above second time period T2 (time period until the target air-fuel ratio abyfr is switched over to the target rich air-fuel ratio afRich) by subtracting the target lean air-fuel ratio elapsed time period TLpass from the duration time TLean of the target lean air-fuel ratio.

As described above, the third control apparatus comprises the evaporated fuel purge section, similarly to the second control apparatus.

Note that, the evaporated fuel purge section of the third control apparatus is configured in such a manner that:

it estimates, in a case in which the operating state of the engine 10 at the purge execution request condition satisfied time point is the first operating state (refer to the "Yes" determinations at both step 620 and step 810), the first time period T1 which is a time period until the target air-fuel ratio abyfr is switched over to the target lean air-fuel ratio afLean when the target air-fuel ratio abyfr is the target rich air-fuel ratio afRich (refer to the "Yes" determination at step 670 shown in FIG. 10); and does not start the evaporated fuel purge if the estimated first time period T1 is shorter than the predetermined first threshold time period T1th (refer to the "Yes" determination at step 1010, and step 690, shown in FIG. 10).

According to the configuration described above, even when the operating state of the engine 10 at the purge execution request condition satisfied time point is the first operating state, and the target air-fuel ratio abyfr is set at the target rich air-fuel ratio afRich, the evaporated fuel purge is not started if the estimated first time period T1 is shorter than the first threshold time period T1th. Consequently, it can be avoided that the state of the catalyst 43 is the oxygen shortage state at a point in time at which, after the fuel introduced into the intake passage by the evaporated fuel purge was combusted to be the exhaust gas, the exhaust gas has reached the catalyst 43. Accordingly, the degrading of the emission can be avoided.

In addition, the evaporated fuel purge section of the third control apparatus is configured in such a manner that:

it estimates, in a case in which the operating state of the engine 10 at the purge execution request condition satisfied time point is the second operating state (refer to the "Yes" determination at step 620, and the "No" determination at step 810, shown in FIG. 10), a second time period T2 which is a time period until the target air-fuel ratio abyfr is switched over to the target rich air-fuel ratio afRich when the target air-fuel ratio abyfr is the target lean air-fuel ratio afLean (refer to the "Yes" determination at step 820 shown in FIG. 10); and does not start the evaporated fuel purge if the estimated second time T2 period is shorter than the predetermined second threshold time period T2th (refer to the "Yes" determination at step 1020, and step 630, shown in FIG. 10).

According to the configuration described above, even when the operating state of the engine 10 at the purge execution request condition satisfied time point is the second operating state, and the target air-fuel ratio abyfr is set at the target lean air-fuel ratio afLean, the evaporated fuel purge is not started if the estimated second time period T2 is shorter than the predetermined second threshold time period T2th. Consequently, it can be avoided that the target air-fuel ratio abyfr has already been changed to the target rich air-fuel ratio afRich before the point in time at which the fuel introduced into the intake passage by the evaporated fuel purge reaches the combustion chamber 21. Accordingly, the "degrading of the drivability due to the unstable combustion state caused by the excessively small air-fuel ratio of the engine 10" can be avoided.

As described above, each control apparatus according to each embodiment of the present invention can perform the evaporated fuel purge without degrading the emission, and further, without sacrificing the drivability.

It should be noted that the present invention should not be limited to the embodiments described above, but various modifications may be adopted without departing from the scope of the invention. For example, the instructed fuel injection amount Fi may be obtained by correcting the base fuel injection amount Fbase according to a formula (2) described below, based on not only the main feedback amount KFmain but also a main feedback learning value KG as well as a purge correction coefficient FPG.

$$Fi=FPG\cdot KG\cdot FAF\cdot Fbase \quad (2)$$

In this case, a "condition that learning the main feedback learning value KG is completed" can be included as one of conditions which constitute the purge execution request condition. That is, the evaporated fuel purge is not carried out when the learning of the main feedback learning value KG has not been completed.

When the evaporated fuel purge is not being performed because the learning of the main feedback learning value KG has not been completed, and when the main feedback control is being performed, a value of the main feedback learning value KG is increased by a value ΔKG per a predetermined time if an average of the main feedback coefficient is larger than "1+α", and is decreased by the value ΔKG per the predetermined time if the average of the main feedback coefficient is smaller than "1−α." It should be noted that the value α is a value larger than 0 and smaller than 1 (e.g., 0.02), and an initial value of the main feedback learning value KG is "1."

Thereafter, when the main feedback control continues, and a duration time of a state in which the average of the main feedback coefficient is between the value "1+α" and the value "1−α" becomes equal to or longer than a threshold duration time, it is determined that the learning of the main feedback learning value KG has been completed.

Further, the purge correction coefficient FPG is obtained according to a formula (3) below. In the formula (3), FGPG is an evaporated fuel gas purge leaning value. PGT is a purge ratio (rate).

$$FPG=1+PGT(FGPG-1) \quad (3)$$

The evaporated fuel gas purge leaning value FGPG is increased by (FAFAV−1)/PGT per a predetermined time when the average of the main feedback coefficient is not between "1+β" and "1−β" while the evaporated fuel purge is being carried out. The target purge ratio PGT is determined based on the load KL, the engine rotational speed NE, and the like. The target purge ratio PGT may be constant. Note that the value β is larger than 0 and smaller than 1 (e.g., 0.02).

Further, in the each of the embodiments described above, the target rich air-fuel ratio afRich may be a value varying depending on the intake air amount Ga, for example, and the target lean air-fuel ratio afLean may be a value varying depending on the intake air amount Ga, for example.

The invention claimed is:

1. A control apparatus for an internal combustion engine, comprising:

a catalyst disposed in an exhaust passage of said engine;

a downstream air-fuel ratio sensor which is an oxygen concentration sensor, disposed in said exhaust passage and at a position downstream of said catalyst;

a target air-fuel ratio determining section configured to determine, based on an output value of said downstream air-fuel ratio sensor, which a target air-fuel ratio being a target value of an air-fuel ratio of a gas flowing into said catalyst should be set to a target rich air-fuel ratio smaller than a stoichiometric air-fuel ratio or a target lean air-fuel ratio larger than said stoichiometric air-fuel ratio, and sets said determined one of said target rich air-fuel ratio and said target lean air-fuel ratio as said target air-fuel ratio;

a fuel injection valve configured to inject a fuel to said engine;

a fuel injection control section configured to determine a fuel injection amount being an amount of said fuel to be injected from said fuel injection valve according to said target air-fuel ratio, and to have said fuel having said determined fuel injection amount be injected from said fuel injection valve; and an evaporated fuel purge section configured to perform an evaporated fuel purge when a predetermined purge execution request condition is satisfied, said evaporated fuel purge being for introducing an evaporated fuel generated in a fuel tank storing said fuel supplied to said fuel injection valve into an intake passage of said engine, wherein, said target air-fuel ratio determining section is configured:

so as to determine that said target air-fuel ratio should be set to said target lean air-fuel ratio, when a change amount ΔVoxs of said output value Voxs of said downstream air-fuel ratio sensor per unit time is a positive value, and a magnitude |ΔVoxs| of said output value becomes larger than a rich determining threshold value dRichth; and so as to determine that said target air-fuel ratio should be set to said target rich air-fuel ratio, when said change amount ΔVoxs of said output value Voxs of said downstream air-fuel ratio sensor per unit time is a negative value, and said magnitude |ΔVoxs| of said output value becomes larger than a lean determining threshold value dLeanth; and said evaporated fuel purge section is configured:

so as to start said evaporated fuel purge when said target air-fuel ratio is set at said target rich air-fuel ratio at a purge execution request condition satisfied time point at which a state changes from a state in which said purge execution request condition is unsatisfied to a state in which said purge execution request condition is satisfied; and so as not to start said evaporated fuel purge when said target air-fuel ratio is set at said target lean air-fuel ratio at said purge execution request condition satisfied time point, and so as to thereafter start said evaporated fuel purge when said target air-fuel ratio is set at said target rich air-fuel ratio after a point in time at which said target air-fuel ratio was changed to said target rich air-fuel ratio.

2. The control apparatus according to claim 1, wherein, said evaporated fuel purge section is configured in such a manner that:

in a case in which an operating state of said engine at said purge execution request condition satisfied time point is a first operating state, said evaporated fuel purge section starts said evaporated fuel purge when said target air-fuel ratio is set at said target rich air-fuel ratio, said evaporated fuel purge section does not start said evaporated fuel purge when said target air-fuel ratio is set at said target lean air-fuel ratio, and starts said evaporated fuel purge when said target air-fuel ratio is set at said target rich air-fuel ratio after said point in time at which said target air-fuel ratio was changed to said target rich air-fuel ratio; and in a case in which said operating state of said engine at said purge execution request condition satisfied time point is a second operating state, said evaporated fuel purge section starts said evaporated fuel purge when said target air-fuel ratio is set at said target lean air-fuel ratio, said evaporated fuel purge section does not start said evaporated fuel purge when said target air-fuel ratio is set at said target rich air-fuel ratio, and starts said evaporated fuel purge when said target air-fuel ratio is set at said target lean air-fuel ratio after a point in time at which said target air-fuel ratio was changed to said target lean air-fuel ratio.

3. The control apparatus according to claim 2, wherein, said evaporated fuel purge section is configured in such a manner that:

said evaporated fuel purge section estimates, in the case in which said operating state of said engine at said purge execution request condition satisfied time point is said first operating state, and when said target air-fuel ratio is said target rich air-fuel ratio, a first time period from a present point in time to a point in time at which said target air-fuel ratio is switched over to said target lean air-fuel ratio; and said evaporated fuel purge section does not start said evaporated fuel purge if said estimated first time period is shorter than a first predetermined threshold time period.

4. The control apparatus according to claim 2, wherein, said evaporated fuel purge section is configured in such a manner that:

said evaporated fuel purge section estimates, in the case in which said operating state of said engine at said purge execution request condition satisfied time point is said second operating state, and when said target air-fuel ratio is said target lean air-fuel ratio, a second time period from a present point in time to a point in time at which said target air-fuel ratio is switched over to said target rich air-fuel ratio; and said evaporated fuel purge section does not start said evaporated fuel purge if said estimated second time period is shorter than a predetermined second threshold time period.

5. The control apparatus according to claim 2, wherein, said first operating state is a state in which a load of said engine is lower than a load threshold; and said second operating state is a state in which said load of said engine is higher than said load threshold.

6. The control apparatus according to claim 2, wherein, said first operating state is a state in which a rotational speed of said engine is lower than a rotational speed threshold; and said second operating state is a state in which said rotational speed of said engine is higher than said rotational speed threshold.

7. The control apparatus according to claim 3 wherein, said evaporated fuel purge section is configured in such a manner that:

said evaporated fuel purge section estimates, in the case in which said operating state of said engine at said purge execution request condition satisfied time point is said second operating state, and when said target air-fuel ratio is said target lean air-fuel ratio, a second time period from a present point in time to a point in time at which said target air-fuel ratio is switched over to said target rich air-fuel ratio; and said evaporated fuel purge section does not start said evaporated fuel purge if said estimated second time period is shorter than a predetermined second threshold time period.

8. The control apparatus according to claim 3, wherein, said first operating state is a state in which a load of said engine is lower than a load threshold; and said second operating state is a state in which said load of said engine is higher than said load threshold.

9. The control apparatus according to claim 4, wherein, said first operating state is a state in which a load of said engine is lower than a load threshold; and said second operating state is a state in which said load of said engine is higher than said load threshold.

10. The control apparatus according to claim 7, wherein, said first operating state is a state in which a load of said engine is lower than a load threshold; and said second operating state is a state in which said load of said engine is higher than said load threshold.

11. The control apparatus according to claim 3, wherein, said first operating state is a state in which a rotational speed of said engine is lower than a rotational speed threshold; and said second operating state is a state in which said rotational speed of said engine is higher than said rotational speed threshold.

12. The control apparatus according to claim 4, wherein, said first operating state is a state in which a rotational speed of said engine is lower than a rotational speed threshold; and said second operating state is a state in which said rotational speed of said engine is higher than said rotational speed threshold.

13. The control apparatus according to claim 5, wherein, said first operating state is a state in which a rotational speed of said engine is lower than a rotational speed threshold; and said second operating state is a state in which said rotational speed of said engine is higher than said rotational speed threshold.

14. The control apparatus according to claim 7, wherein, said first operating state is a state in which a rotational speed of said engine is lower than a rotational speed threshold; and said second operating state is a state in which said rotational speed of said engine is higher than said rotational speed threshold.

15. The control apparatus according to claim 8, wherein, said first operating state is a state in which a rotational speed of said engine is lower than a rotational speed threshold; and said second operating state is a state in which said rotational speed of said engine is higher than said rotational speed threshold.

16. The control apparatus according to claim 9, wherein, said first operating state is a state in which a rotational speed of said engine is lower than a rotational speed threshold; and said second operating state is a state in which said rotational speed of said engine is higher than said rotational speed threshold.

17. The control apparatus according to claim 10, wherein, said first operating state is a state in which a rotational speed of said engine is lower than a rotational speed threshold; and said second operating state is a state in which said rotational speed of said engine is higher than said rotational speed threshold.

* * * * *